US012310547B2

(12) United States Patent
Udy et al.

(10) Patent No.: US 12,310,547 B2
(45) Date of Patent: May 27, 2025

(54) AGITATOR WITH HAIR REMOVAL

(71) Applicant: SHARKNINJA OPERATING LLC, Needham, MA (US)

(72) Inventors: Adam Udy, Sutton (GB); Andre D. Brown, Natick, MA (US); Steven P. Carter, London (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/393,800

(22) Filed: Dec. 22, 2023

(65) Prior Publication Data

US 2024/0115092 A1 Apr. 11, 2024

Related U.S. Application Data

(63) Continuation of application No. 17/587,569, filed on Jan. 28, 2022, which is a continuation of application (Continued)

(51) Int. Cl.
*A47L 9/04* (2006.01)
*A46B 13/00* (2006.01)

(Continued)

(52) U.S. Cl.
CPC ..... *A47L 9/0477* (2013.01); *A46B 13/006* (2013.01); *A47L 7/0066* (2013.01); *A47L 9/0411* (2013.01); *A47L 9/1409* (2013.01)

(58) Field of Classification Search
CPC ... A46B 13/006; A47L 9/0477; A47L 7/0066; A47L 9/0411; A47L 9/1409
See application file for complete search history.

(56) References Cited

U.S. PATENT DOCUMENTS 2,587,038 A 2/1952 Goodell
2,734,212 A * 2/1956 Koch ..... A47L 9/0477 15/183

(Continued)

FOREIGN PATENT DOCUMENTS

CA 2744592 A1 * 1/2012 ..... A46B 13/006
CN 1887171 1/2007

(Continued)

OTHER PUBLICATIONS

Bissell Cleanview Swivel Pet Brushroll Vendor Data (Year: 2016).*

(Continued)

*Primary Examiner* — Marc Carlson
(74) *Attorney, Agent, or Firm* — Grossman Tucker Perreault & Pfleger, PLLC

(57) ABSTRACT

A rotatable agitator is used in a surface clearing head of a surface cleaning apparatus. The agitator is coupled to the cleaning head at least partially within an agitator chamber and is rotated about a pivot axis. The agitator includes an elongated agitator body and a hair migration portion. The hair migration portion includes a continuous row of bristles and a sidewall. The continuous row of bristles and sidewall are at least partially revolved around and extend along at least a portion of the pivot axis from one of a collection area or a first end region of the agitator and either another collection area or a second end region of the agitator. The sidewall extends substantially parallel to the continuous row of bristles within the hair migration portion. The continuous row of bristles and sidewall are configured to reduce hair from becoming entangled in the bristles and to migrate hair towards the collection area or the first end region of the agitator.

24 Claims, 14 Drawing Sheets

Related U.S. Application Data

No. 15/699,358, filed on Sep. 8, 2017, now Pat. No. 11,234,568.

(60) Provisional application No. 62/385,572, filed on Sep. 9, 2016.

(51) Int. Cl.
*A47L 7/00* (2006.01)
*A47L 9/14* (2006.01)

(56) References Cited

U.S. PATENT DOCUMENTS 2,785,431 A 3/1957 Pardee
2,960,714 A 11/1960 Senne
3,612,052 A 10/1971 Krummenacher
3,737,937 A 6/1973 Nordeen
3,828,430 A 8/1974 Yamada et al.
4,177,536 A * 12/1979 Powers ..... A47L 5/30 15/366
4,307,479 A * 12/1981 Mertes ..... A46B 7/04 15/207.2
4,372,004 A * 2/1983 Vermillion ..... A47L 5/30 15/195
4,384,386 A 5/1983 Dorner et al.
4,955,107 A 9/1990 Kawai
5,109,976 A 5/1992 Mohri et al.
5,435,038 A 7/1995 Sauers
5,482,562 A 1/1996 Abernathy
5,495,634 A * 3/1996 Brundula ..... A47L 9/0477 15/179
5,611,109 A 3/1997 Worwag
6,058,582 A * 5/2000 Gardner ..... D06C 11/00 26/29 R
6,170,119 B1 1/2001 Conrad et al.
6,237,188 B1 5/2001 Takemoto et al.
6,367,781 B1 4/2002 Flynn et al.
6,539,575 B1 4/2003 Cohen
6,892,420 B1 5/2005 Haan et al.
D518,258 S * 3/2006 Hamm ..... D32/31
7,007,336 B2 3/2006 Roney et al.
7,140,062 B1 * 11/2006 Chen ..... A47L 9/04 15/179
7,690,079 B2 4/2010 Boddy et al.
7,979,952 B2 7/2011 Beskow et al.
8,060,967 B1 11/2011 Johnson, Jr.
8,083,167 B1 12/2011 Namakian et al.
8,087,117 B2 1/2012 Kapoor et al.
D680,289 S 4/2013 Gray et al.
8,418,303 B2 4/2013 Kapoor et al.
8,505,158 B2 8/2013 Han et al.
8,572,799 B2 11/2013 Won et al.
8,601,643 B2 12/2013 Eriksson
8,671,515 B2 3/2014 Eriksson
9,066,640 B2 6/2015 Iles et al.
9,072,416 B2 7/2015 Kowalski
9,192,273 B2 11/2015 Eriksson
9,295,362 B2 3/2016 Eriksson
9,295,364 B2 3/2016 Eriksson
9,314,140 B2 4/2016 Eriksson
9,320,398 B2 4/2016 Hussey et al.
9,320,399 B2 * 4/2016 Ventress ..... A46B 9/026
9,375,122 B2 6/2016 Eriksson
9,492,048 B2 11/2016 Won et al.
9,615,708 B2 4/2017 Kowalski
9,756,998 B2 * 9/2017 Kasper ..... A47L 9/0411
9,775,477 B2 * 10/2017 Eriksson ..... A47L 9/0466
9,820,624 B2 11/2017 Eriksson
9,820,626 B2 11/2017 Eriksson et al.
9,833,115 B2 12/2017 Eriksson
9,839,335 B2 12/2017 Eriksson
10,045,672 B2 * 8/2018 Eriksson ..... A46B 17/06
10,314,449 B2 6/2019 Blouin
11,109,735 B2 9/2021 Gunter et al.
11,395,569 B2 * 7/2022 Kasper ..... A46B 13/001
11,647,881 B2 * 5/2023 Thorne ..... A47L 5/26 15/366
2002/0124334 A1 9/2002 Worwag
2003/0204923 A1 11/2003 Nakamura
2006/0042042 A1 3/2006 Mertes et al.
2006/0053584 A1 3/2006 Dever
2007/0209147 A1 9/2007 Krebs et al.
2008/0052846 A1 3/2008 Kapoor et al.
2008/0115736 A1 5/2008 Porter et al.
2009/0205153 A1 * 8/2009 Morphey ..... A46B 13/02 15/182
2010/0011529 A1 1/2010 Won et al.
2010/0107357 A1 * 5/2010 Odachi ..... A47L 9/0411 15/389
2010/0313912 A1 12/2010 Han et al.
2011/0252594 A1 10/2011 Blouin
2012/0084938 A1 4/2012 Fu
2012/0169497 A1 7/2012 Schnittman et al.
2013/0007982 A1 * 1/2013 Yun ..... A47L 9/1683 15/347
2013/0042429 A1 * 2/2013 Misumi ..... A46B 17/06 15/415.1
2013/0058635 A1 3/2013 Vrdoljak
2013/0152337 A1 6/2013 Thorne
2013/0198995 A1 * 8/2013 Eriksson ..... A47L 9/2805 15/383
2014/0053351 A1 * 2/2014 Kapoor ..... A47L 11/4013 15/52.1
2014/0143978 A1 5/2014 Li et al.
2014/0150201 A1 6/2014 McGee et al.
2014/0173849 A1 * 6/2014 Ando ..... A46B 3/16 15/207.2
2014/0196236 A1 * 7/2014 Ventress ..... A47L 9/0477 15/182
2014/0259521 A1 * 9/2014 Kowalski ..... A47L 9/0411 15/383
2014/0259522 A1 * 9/2014 Kasper ..... A47L 9/1683 15/383
2014/0359968 A1 * 12/2014 Eriksson ..... A47L 9/0477 15/390
2014/0366300 A1 12/2014 Eriksson
2015/0013102 A1 1/2015 Bilger
2015/0040340 A1 2/2015 Bilger et al.
2015/0135474 A1 5/2015 Gidwell
2015/0230676 A1 8/2015 Eriksson
2015/0297054 A1 10/2015 Weeks et al.
2015/0313431 A1 11/2015 Eriksson
2015/0342430 A1 * 12/2015 Kasper ..... A46B 13/006 15/183
2015/0351596 A1 12/2015 Thorne
2016/0058257 A1 3/2016 Ventress et al.
2016/0128530 A1 5/2016 Thorne et al.
2016/0166052 A1 * 6/2016 Kasper ..... A46B 13/001 15/179
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0220084 A1 * 8/2016 Xu ..... A47L 9/0444
2016/0324388 A1 11/2016 Vrdoljak et al.
2016/0345792 A1 * 12/2016 Herron ..... A47L 9/0477
2016/0374533 A1 12/2016 Innes et al.
2017/0042319 A1 2/2017 Conrad et al.
2017/0112343 A1 4/2017 Innes et al.
2017/0127896 A1 5/2017 Carter et al.
2017/0144810 A1 5/2017 Birdsell
2017/0172363 A1 6/2017 Eriksson et al.
2017/0172364 A1 6/2017 Eriksson
2017/0209008 A1 7/2017 Isley et al.
2017/0215667 A1 8/2017 Thorne et al.
2017/0280957 A1 10/2017 Jeong et al.
2017/0311767 A1 11/2017 Fang
2017/0347848 A1 12/2017 Carter et al.
2018/0035854 A1 2/2018 Thorne
2018/0064301 A1 3/2018 Cottrell et al.
2018/0068815 A1 3/2018 Cottrell
2018/0070785 A1 * 3/2018 Udy ..... A47L 9/1409

(56) References Cited

U.S. PATENT DOCUMENTS

| | | | | |
|---|---|---|---|---|
| 2018/0184862 | A1 | 7/2018 | Choi et al. | |
| 2018/0255991 | A1 | 9/2018 | Der Marderosian et al. | |
| 2018/0296046 | A1 | 10/2018 | Thorne et al. | |
| 2018/0306432 | A1 | 10/2018 | Ognjen et al. | |
| 2018/0325252 | A1 | 11/2018 | Hopke et al. | |
| 2018/0338654 | A1 | 11/2018 | Kelsey | |
| 2018/0338656 | A1 | 11/2018 | Carter et al. | |
| 2019/0038098 | A1 | 2/2019 | Thorne et al. | |
| 2019/0059668 | A1 | 2/2019 | Thorne et al. | |
| 2019/0069740 | A1 | 3/2019 | Thorne et al. | |
| 2019/0069744 | A1 | 3/2019 | Liggett et al. | |
| 2019/0090701 | A1 | 3/2019 | Tonderys et al. | |
| 2019/0090705 | A1 | 3/2019 | Thorne et al. | |
| 2019/0191947 | A1 | 6/2019 | Freese et al. | |
| 2019/0193120 | A1 | 6/2019 | Brown et al. | |
| 2019/0274500 | A1 | 9/2019 | Thorne et al. | |
| 2019/0307302 | A1* | 10/2019 | Zheng | A47L 9/0477 |
| 2020/0046183 | A1* | 2/2020 | Choi | A47L 9/0477 |
| 2020/0085269 | A1 | 3/2020 | Thorne | |
| 2020/0205631 | A1 | 7/2020 | Brown et al. | |
| 2020/0297172 | A1 | 9/2020 | Tonderys et al. | |
| 2021/0169289 | A1 | 6/2021 | Thorne et al. | |
| 2021/0254615 | A1 | 8/2021 | Burbank | |
| 2022/0071459 | A1* | 3/2022 | Gacin | A47L 9/0411 |

FOREIGN PATENT DOCUMENTS

| | | | | |
|---|---|---|---|---|
| CN | 101076277 | | 11/2007 | |
| CN | 201595776 | | 10/2010 | |
| CN | 102481080 | | 5/2012 | |
| CN | 102727136 | | 10/2012 | |
| CN | 103829882 | | 6/2014 | |
| CN | 203914774 | | 11/2014 | |
| CN | 104605789 | | 5/2015 | |
| CN | 204427936 | | 7/2015 | |
| CN | 105982615 | A | 10/2016 | |
| CN | 205671990 | U | 11/2016 | |
| CN | 107233047 | A | 10/2017 | |
| DE | 102007006654 | | 8/2008 | |
| DE | 102015106094 | A1 * | 11/2016 | |
| DE | 102019106501 | | 9/2020 | |
| EP | 1827192 | | 9/2007 | |
| EP | 2543301 | | 1/2013 | |
| EP | 2570067 | | 3/2013 | |
| EP | 2941994 | | 11/2015 | |
| EP | 3073881 | | 10/2016 | |
| GB | 583738 | | 12/1946 | |
| GB | 2310213 | A | 8/1997 | |
| GB | 2546540 | A * | 7/2012 | A46B 13/006 |
| JP | S62155812 | | 7/1987 | |
| JP | H0670868 | | 3/1994 | |
| JP | 07039488 | | 2/1995 | |
| JP | H08131374 | | 5/1996 | |
| JP | 2000139786 | | 5/2000 | |
| JP | 2008043351 | | 2/2008 | |
| JP | 2008161260 | | 7/2008 | |
| JP | 2010246848 | | 11/2010 | |
| JP | 2011188951 | | 9/2011 | |
| KR | 1020130107152 | | 10/2013 | |
| KR | 1020170111688 | | 10/2017 | |
| WO | WO-0076385 | A1 * | 12/2000 | A47L 9/0411 |
| WO | 2009117383 | | 9/2009 | |
| WO | 2014095604 | | 6/2014 | |
| WO | 2014140872 | A2 | 9/2014 | |
| WO | 2016030756 | | 3/2016 | |

OTHER PUBLICATIONS

Chinese Office Action with machine-generated English translation issued Sep. 22, 2023, received in Chinese Patent Application No. 201780055478.6, 41 pages.

Chinese Office Action with machine-generated English translation issued Sep. 14, 2023, received in Chinese Patent Application No. 202111652130.X, 9 pages.

Australian Office Action issued Dec. 20, 2022, received in Australian Patent Application No. 2021202946, 4 pages.

European Examination Report issued Jan. 17, 2023, received in European Patent Application No. 18897246.7, 4 pages.

U.S. Office Action mailed Mar. 27, 2023, received in U.S. Appl. No. 17/182,090, 15 pages.

Chinese Office Action with machine-generated translation issued May 27, 2023, received in Chinese Application No. 202111652130.X, 10 pages.

PCT Search Report and Written Opinion mailed Aug. 24, 2018, received in corresponding PCT Application No. PCT/US18/34668, 7 pgs.

PCT Search Report and Written Opinion mailed Mar. 5, 2019, received in corresponding PCT Application No. PCT/US18/67171, 8 pgs.

PCT Search Report and Written Opinion mailed May 3, 2019, received in corresponding PCT Application No. PCT/US18/67163, 14 pgs.

UK Examination Report issued Nov. 16, 2021, received in UK Patent Application No. GB1903295.2, 2 pages.

Canadian Examiners Report issued Nov. 6, 2020, received in Canadian Application No. 3,036,354, 4 pgs.

EP Search Report issued Dec. 1, 2020, received in EP Application No. 18763596.6, 7 pgs.

EP Search Report issued Nov. 26, 2020, received in EP Application No. 18806571.8, 7 pgs.

EP Search Report issued Nov. 26, 2020, received in EP Application No. 18894320.3, 6 pgs.

EP Search Report issued Nov. 25, 2020, received in EP Application No. 18897246.7, 7 pgs.

US Office Action issued Nov. 13, 2020, received in U.S. Appl. No. 16/229,796, 14 pgs.

PCT International Search Report and Written Opinion mailed Jun. 6, 2018, received in corresponding PCT Application No. PCT/US18/21888, 12 pgs.

Chinese Office Action with translation issued May 24, 2021, received in China Application No. 201780055478.6, 8 pgs.

Chinese Office Action with English translation issued May 22, 2020, received in Chinese Patent Application No. 201880043227.0, 8 pgs.

PCT Search Report and Written Opinion mailed Dec. 20, 2017, received in corresponding PCT Application No. PCT/US17/50691, 11 pgs.

Canadian Office Action issued Mar. 4, 2020, received in Canadian Patent Application No. 3,036,354, 4 pgs.

US Office Action issued Apr. 29, 2020, received in U.S. Appl. No. 15/917,598, 12 pgs.

Canadian Office Action issued Aug. 13, 2021, received in Canadian Patent Application No. 3,036,354, 3 pages.

Chinese Office Action with English translation issued Aug. 18, 2021, received in Chinese Patent Application No. 201880090292.9, 11 pages.

Chinese Decision of Rejection with English translation issued Sep. 3, 2021, received in Chinese Patent Application No. 201780055478.6, 7 pages.

Chinese Office Action with translation issued Sep. 1, 2020, received in Chinese Application No. 201880023329.6, 12 pgs.

Chinese Office Action with translation issued Sep. 1, 2020, received in Chinese Application No. 201780055478.6, 10 pgs.

Chinese Office Action with English translation issued Jun. 3, 2021, received in Chinese Patent Application No. 201880090257.7, 16 pages.

UK Examination Report dated Jul. 8, 2021, received in U.K. Patent Application No. GB1903295.2, 2 pages.

U.S. Office Action mailed Sep. 16, 2019, received in U.S. Appl. No. 16/229,796, 12 pages.

Chinese Office Action with English translation issued Apr. 27, 2021, received in Chinese Patent Application No. 201880023329.6, 13 pages.

(56) References Cited

OTHER PUBLICATIONS

US Office Action mailed Feb. 16, 2022, received in U.S. Appl. No. 16/229,363, 10 pages.
Chinese Office Action with English translation issued Mar. 2, 2022, received in Chinese Patent Application No. 202110308172.5, 11 pages.
Chinese Office Action with English translation issued Apr. 1, 2022, received in Chinese Patent Application No. 201880090257.7, 6 pages.
Japanese Office Action with English translation mailed Apr. 21, 2022, received in Japanese Patent Application No. 2021-075166, 7 pages.
Chinese Office Action with English Summary issued Sep. 16, 2022, received in Chinese Patent Application No. 202111652130.X, 12 pages.
US Office Action mailed Aug. 12, 2022, received in U.S. Appl. No. 16/229,363, 11 pages.
Chinese Office Action with English Summary issued Oct. 12, 2022, received in Chinese Patent Application No. 202110308172.5, 9 pages.
U.S. Office Action mailed Nov. 18, 2022, received in U.S. Appl. No. 17/170,331, 9 pages.
U.S. Office Action issued Mar. 14, 2024, received in U.S. Appl. No. 17/587,569, 26 pages.
U.S. Office Action dated Jul. 2, 2024, received in U.S. Appl. No. 17/587,569, 25 pages.

* cited by examiner

AGITATOR WITH HAIR REMOVAL

CROSS REFERENCE TO RELATED APPLICATIONS

The present application is a continuation application of co-pending application Ser. No. 17/587,569 filed Jan. 28, 2022, which is a continuation application of application Ser. No. 15/699,358 filed Sep. 8, 2017, now U.S. Pat. No. 11,234,568, which claims the benefit of U.S. Provisional Application Ser. No. 62/385,572, filed on Sep. 9, 2016, all of which are fully incorporated herein by reference.

TECHNICAL FIELD

This specification relates to surface cleaning apparatuses, and more particularly, to agitators for reducing and/or preventing hair from becoming entangled and for migrating hair along the agitator.

BACKGROUND INFORMATION

The following is not an admission that anything discussed below is part of the prior art or part of the common general knowledge of a person skilled in the art.

A surface cleaning apparatus may be used to clean a variety of surface. Some surface cleaning apparatuses include a rotating agitator (e.g., brush roll). One example of a surface cleaning apparatus includes a vacuum cleaner which may include a rotating agitator as well as vacuum source. Non-limiting examples of vacuum cleaners include upright vacuum cleaners, canister vacuum cleaners, stick vacuum cleaners, and central vacuum systems. Another type of surface cleaning apparatus includes powered broom which includes a rotating agitator (e.g., brush roll) that collects debris, but does not include a vacuum source.

While the known surface cleaning apparatuses are generally effective at collecting debris, some debris (such as hair) may become entangled in the agitator. The entangled hair may reduce the efficiency of the agitator, and may cause damage to the motor and/or gear train that rotates the agitator. Moreover, it may be difficult to remove the hair from the agitator because the hair is entangled in the bristles.

BRIEF DESCRIPTION OF THE DRAWINGS

These and other features advantages will be better understood by reading the following detailed description, taken together with the drawings wherein:

FIG. 3 is another bottom view of the surface cleaning apparatus of FIG. 1 with hair wrapped around the agitator;

Figure 1:
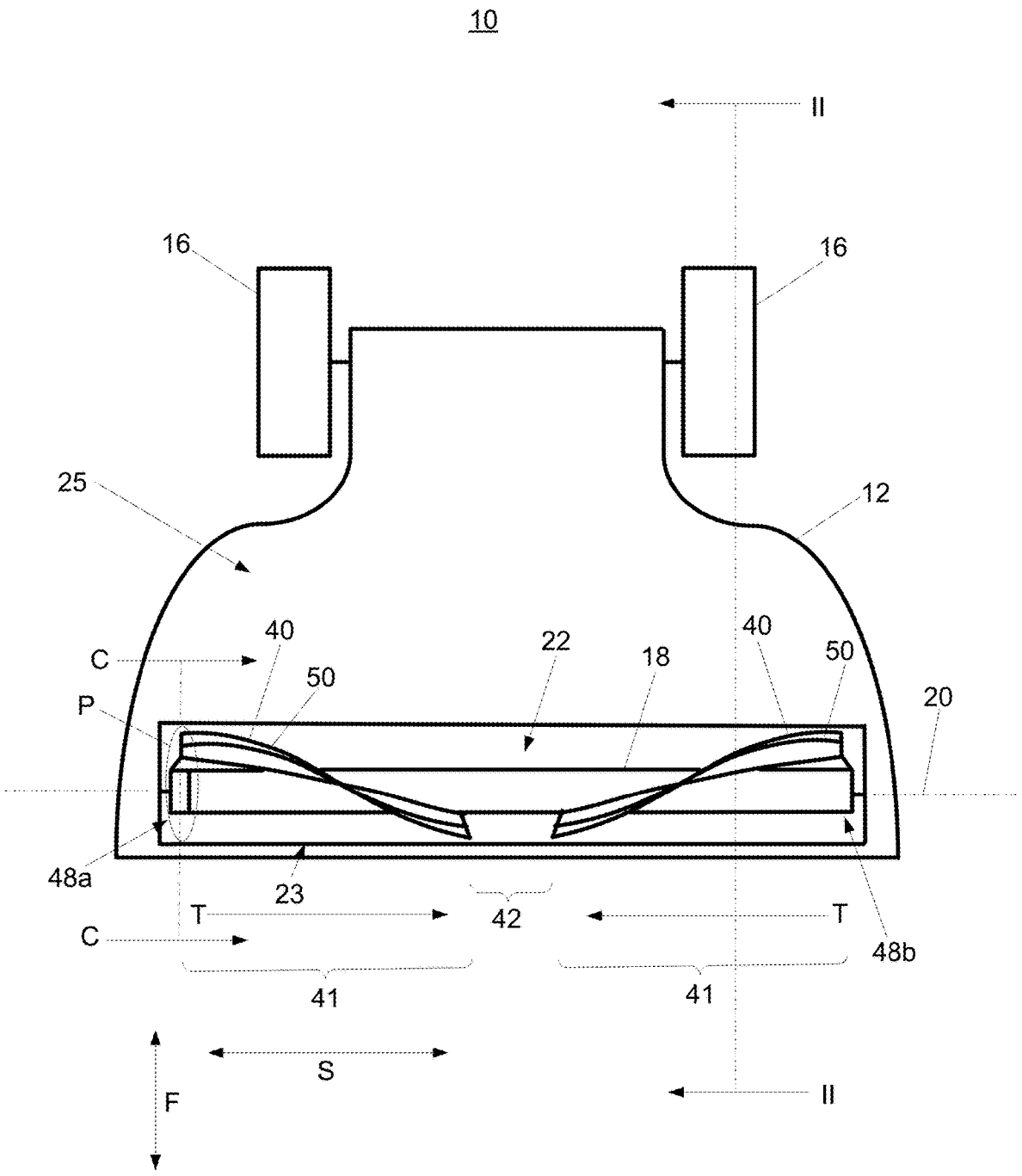
FIG. 1 is a bottom view of one embodiment of a surface cleaning apparatus, consistent with the present disclosure.

The drawings included herewith are for illustrating various examples of articles, methods, and apparatuses of the teaching of the present specification and are not intended to limit the scope of what is taught in any way.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

By way of a general overview, one aspect of the present disclosure features systems and methods for migrating hair on a surface cleaning apparatus. As described herein, a surface cleaning apparatus may include an agitator/brush roll having an elongated body configured to rotate about a pivot axis at least partially within a cleaning head. The agitator includes one or more hair migration portions configured to prevent hair from becoming entangled in the bristles and to urge/migrate hair to a collection area and/or an end of the agitator. The hair migration portion includes at least one continuous row of bristles and at least one sidewall proximate to (e.g., immediately adjacent to and/or substantially parallel to) at least one of the continuous rows of bristles within the hair migration portion. The continuous row of bristles and sidewalls are at least partially revolved around and extend along at least a portion of the longitudinal axis/pivot axis of the elongated agitator body within the hair migration portion (i.e., from one of a collection area or an end region of the agitator and either another collection area or another end region of the elongated agitator body). The continuous rows of bristles and continuous sidewall of the hair migration portions are configured to reduce hair from becoming entangled in the bristles of the agitator and configured to generate an Archimedes screw force that urges/causes the hair to migrate towards one or more collection areas and/or ends of the agitator. As a result, the agitator of the present disclosure may be configured to generally prevent the hair from excessively building up the agitator and reducing the efficiency of the agitator and/or causing damage to the surface cleaning apparatus (e.g., the rotation systems or the like). Additionally, the hair migration portions may cause the migrated hair to automatically fall off of (e.g., remove) from the agitator and/or may cause the hair to be migrated and collected in one or more collection areas, thereby simplifying the process for removing the hair from the agitator.

Figure 2:
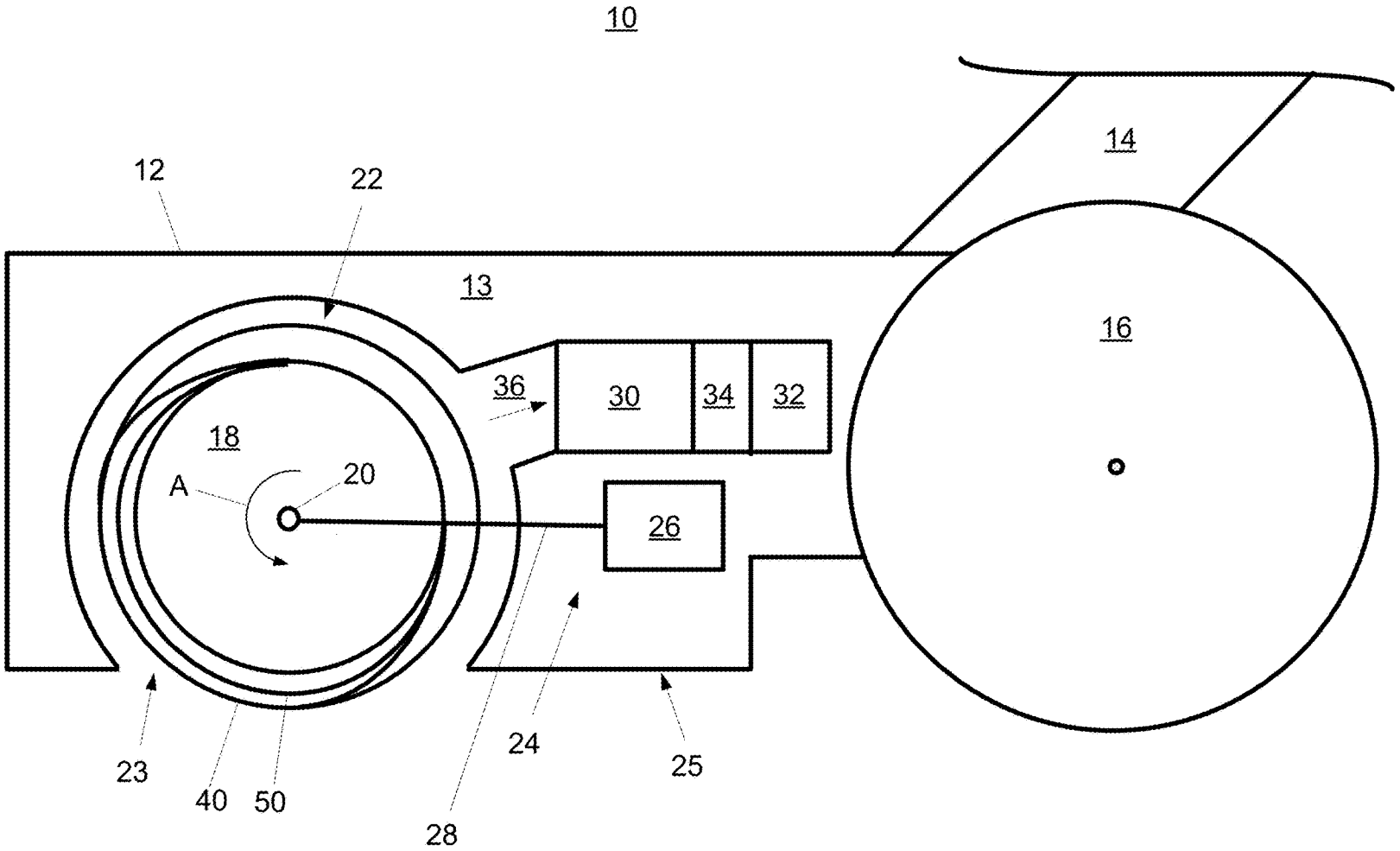
FIG. 2 is a cross-sectional view of the surface cleaning apparatus of FIG. 1 taken along line II-II.

Turning now to FIGS. 1 and 2, one embodiment of a surface cleaning apparatus 10 is generally illustrated. In particular, FIG. 1 generally illustrates a bottom view of a surface cleaning apparatus 10 and FIG. 2 generally illustrates a cross-section of the surface cleaning apparatus 10 taken along lines II-II of FIG. 1. The surface cleaning apparatus 10 includes a cleaning head 12 and optionally a handle 14. In the illustrated embodiment, the handle 14 is pivotally coupled to the cleaning head 12 such that the user may grasp the handle 14 while standing to move the cleaning head 12 on the surface to be cleaned using one or more wheels 16. It should be appreciated; however, that the cleaning head 12 and the handle 14 may be an integrated or unitary structure (e.g., such as a handleheld vacuum). Alternatively, the handle 14 may be eliminated (e.g., such as a robot-type vacuum).

The cleaning head 12 includes a cleaning head body or frame 13 that at least partially defines/includes one or more agitator chambers 22. The agitator chambers 22 include one or more openings 23 defined within and/or by a portion of the bottom surface/plate 25 of the cleaning head 12/cleaning head body 13. At least one rotating agitator or agitator 18 is configured to be coupled to the cleaning head 12 (either permanently or removably coupled thereto) and is configured to be rotated about a pivot axis 20 (e.g., in the direction and/or reverse direction of arrow A) within the agitator chambers 22 by one or more rotation systems 24. The rotation systems 24 may be at least partially disposed in the vacuum head 12 and/or handle 16, and may one or more motors 26 (either AC and/or DC motors) coupled to one or more belts and/or gear trains 28 for rotating the agitators 18.

The surface cleaning apparatus 10 includes a debris collection chamber 30 in fluid communication with the agitator chamber 22 such that debris collected by the rotating agitator 18 may be stored. Optionally, the agitator chamber 22 and debris chamber 30 are fluidly coupled to a vacuum source 32 (e.g., a vacuum pump or the like) for generating a partial vacuum in the agitator chamber 22 and debris collection chamber 30 and to suck up debris proximate to the agitator chamber 22 and/or agitator 18. As may be appreciated, the rotation of the agitator 18 may aid in agitating/loosening debris from the cleaning surface. Optionally, one or more filters 34 may be provided to remove any debris (e.g., dust particles or the like) entrained in the partial vacuum air flow. The debris chamber 30, vacuum source 32, and/or filters 34 may be at least partially located in the cleaning head 12 and/or handle 14. Additionally, one or more tubes, ducts, or the like 36 may be provided to fluidly couple the debris chamber 30, vacuum source 32, and/or filters 34. The surface cleaning apparatus 10 may include and/or may be configured to be electrically coupled to one or more power sources such as, but not limited to, an electrical cord/plug, batteries (e.g., rechargeable, and/or non-rechargeable batteries), and/or circuitry (e.g., AC/DC converters, voltage regulators, step-up/down transformers, or the like) to provide electrical power to various components of the surface cleaning apparatus 10 such as, but not limited to, the rotation systems 24 and/or the vacuum source 32.

The agitator 18 (FIGS. 1 and 3) includes an elongated agitator body 44 that is configured to extend along and rotate about a longitudinal/pivot axis 20. The agitator 18 (e.g., but not limited to, one or more of the ends of the agitator 18) is permanently or removably coupled to the vacuum head 12 and may be rotated about the pivot axis 20 by the rotation system 24. In the illustrated embodiment, the elongated agitator body 44 has a generally cylindrical cross-section, though other cross-sectional shapes (such as, but not limited to, oval, hexagonal, rectangular, octagonal, concaved, convex, and the like) are also possible.

Figure 3:
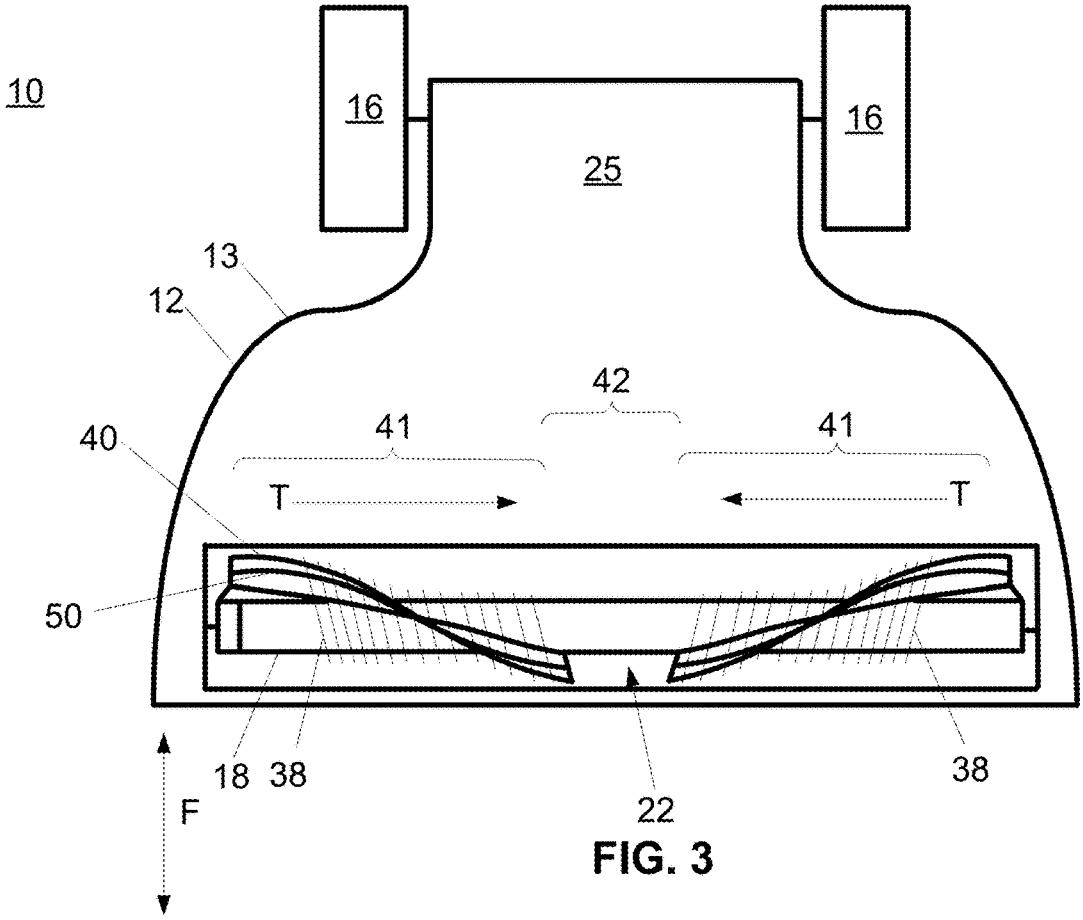
FIG. 3 is another bottom view of one embodiment of the surface cleaning apparatus of FIG. 1 with hair wrapped around the agitator.

With reference to FIG. 3, the surface cleaning apparatus 10, and specifically the agitator 18, may come into contact with elongated debris such as, but not limited to, hair, string, fibers, and the like (hereinafter collectively referred to as hair 38 for ease of explanation). The hair 38 may have a length that is much longer than the diameter of the agitator 18. By way of a non-limiting example, the hair 38 may have a length that is 2-10 times longer than the diameter of the agitator 18. Because of the rotation of the agitator 18 as well as the length and flexibility of the hair 38, the hair 38 will tend to wrap around the diameter of the agitator 18 as generally illustrated FIG. 3.

Figure 4:
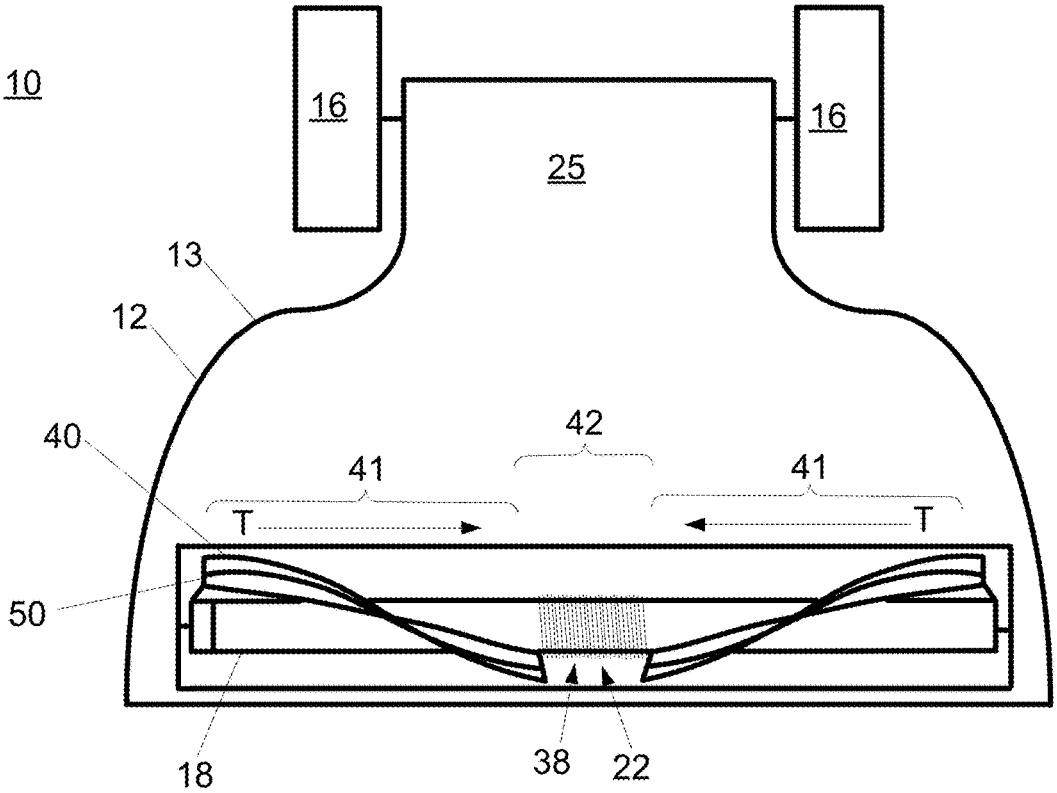
FIG. 4 is another bottom view of the surface cleaning apparatus of FIG. 1 with hair wrapped around the collection area.
Figure 5:
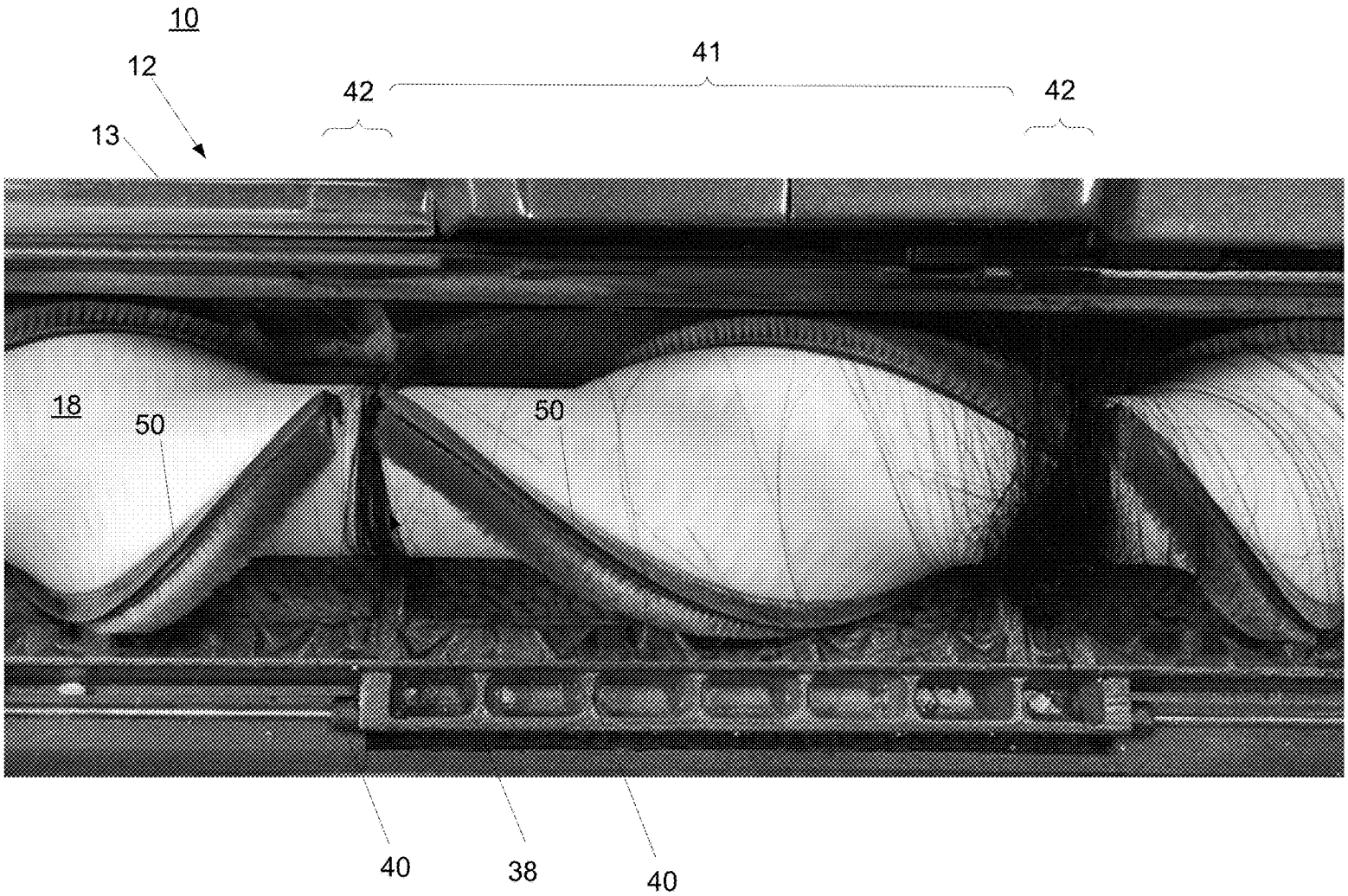
FIG. 5 is another bottom view of a surface cleaning apparatus with hair wrapped around the collection area.

To address the problem of hair wrapping around the agitator 18, the agitator 18 of the present disclosure features one or more hair migration portions 41 and optionally one or more collection areas 42. In particular, each of the hair migration portions 41 of the agitator 18 includes a plurality of bristles 40 aligned in one or more continuous rows or strips 46*a-n* as well as one or more continuous sidewalls 50 adjacent to at least one row 46*a-n* of bristles 40. The continuous rows 46*a-n* of bristles 40 and continuous sidewall 50 of the hair migration portions 41 are configured to reduce hair 38 from becoming entangled in the bristles 40 of the agitator 18 and configured to generate an Archimedes screw force that urges/causes the hair 38 to migrate towards one or more collection areas 42 and/or ends of the agitator 18 as generally illustrated in FIGS. 4 and 5. As a result, the agitator 18 of the present disclosure may be configured to generally prevent the hair 38 from excessively building up the agitator 18 and reducing the efficiency of the agitator 18 and/or causing damage to the surface cleaning apparatus 10 (e.g., the rotation systems 24 or the like). Additionally, the hair migration portions 41 may cause the migrated hair to automatically fall off of (e.g., remove) from the agitator 18 and/or may cause the hair to be migrated and collected in one or more collection areas 42, thereby simplifying the process for removing the hair from the agitator 18.

Figure 6:
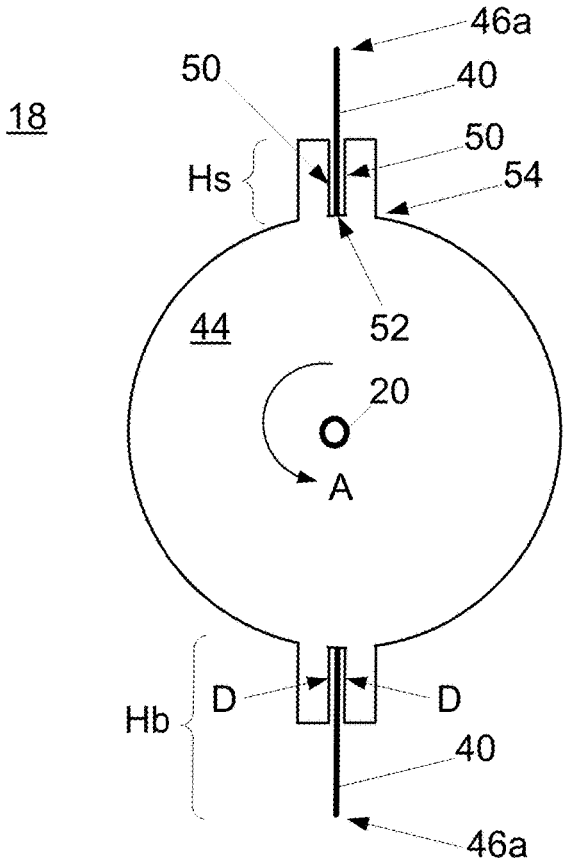
FIG. 6 is a cross-sectional view of one embodiment of the agitator of FIG. 1 taken along lines C-C in region P.
Figure 7:
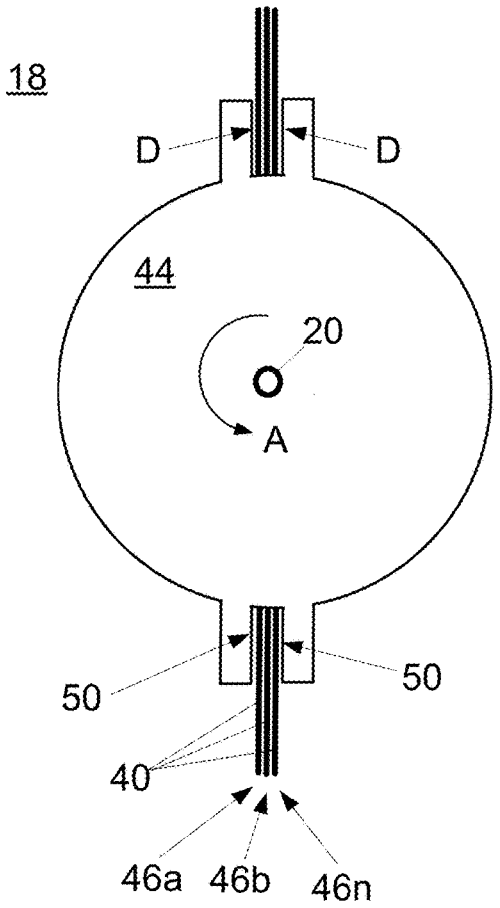
FIG. 7 is a cross-sectional view of another embodiment of the agitator of FIG. 1 taken along lines C-C in region P.

Turning now to FIGS. 6 and 7, cross-sectional views of a first and a second embodiment of a hair migration area 41 of an agitator 18 taken along lines C-C of portion P of FIG. 1 are generally illustrated. Each hair migration portion 41 includes a plurality of bristles 40 that extend outward (e.g., generally radial outward) from the elongated agitator body 44 (e.g., a base portion 52) to define one (FIG. 6) or more (FIG. 7) continuous rows 46*a-n*. One or more of the continuous rows 46*a-n* of bristles 40 may be coupled (either permanently or removably coupled) to the elongated agitator body 44 (e.g., to a base region 52 of the body 44) using one or more form locking connections (such as, but not limited to, a tongue and groove connection, a T-groove connection, or the like), interference connections (e.g., interference fit, press fit, friction fit, Morse taper, or the like), adhesives, fasteners overmoldings, or the like.

As noted above, each hair migration portion 41 of the agitator 18 includes a plurality of bristles 40 that are aligned in and/or define at least one continuous row 46*a-n*. One or more of the continuous rows 46*a-n* of bristles 40 at least partially revolves around and extends along at least a portion of the longitudinal axis/pivot axis 20 of the elongated agitator body 44 of the agitator 18 within the hair migration portion 41 (i.e., from one of a collection area 41 or an end region 48*a* of the agitator 18 and either another collection area 42 or another end region 48*b* of the elongated agitator body 44). For example, one or more of the continuous rows 46*a-n* of bristles 40 extend from a collection area 42, FIG. 1, and either another collection area 42 or one of the end region 48*a*, 48*b* of the elongated agitator body 44. As defined herein, a continuous row 46*a-n* of bristles 40 is defined as a plurality of bristles 40 in which the spacing between adjacent bristles 40 along the axis of rotation 20 is less than or equal to 3 times the largest cross-sectional dimension (e.g., diameter) of the bristles 40.

As mentioned above, the plurality of bristles 40 are aligned in and/or define at least one continuous row 46*a-n* that at least partially revolves around and extends along at least a portion of the longitudinal axis/pivot axis 20 of the elongated agitator body 44 of the agitator 18 from one of a collection area 41 or an end region 48*a* of the agitator 18 and either another collection area 42 or another end region 48*b* of the elongated agitator body 44. For example, at least one of the continuous rows 46*a-n* of bristles 40 may be arranged in a generally helical, arcuate, and/or chevron configuration/pattern/shape. Optionally, one or more of the continuous rows 46*a-n* of bristles 40 (e.g., the entire row or a portion thereof) may have a constant pitch (e.g., constant helical pitch). Alternatively (or in addition), one or more of the continuous rows 46*a-n* of bristles 40 (e.g., the entire row or a portion thereof) may have a variable pitch (e.g., variable helical pitch). For example, at least a portion of the continuous row 46*a-n* of bristles 40 may have a variable pitch that is configured to accelerate the migration of hair 38 as the hair 38 migrates towards a collection area 42 and/or an end region 48*a*, 48*b* of the agitator 18.

At least one continuous row 46*a-n* of bristles 40 is proximate to (e.g., immediately adjacent to) at least one sidewall 50. The sidewall 50 may be disposed as close as possible to the nearest continuous row 46*a-n* of bristles 40, while still allowing the bristles 40 to bend freely left-to-right. For example, one or more of the sidewalls 50 may extend substantially continuously within the hair migration portion 41. In one embodiment, at least one sidewall 50 extends substantially parallel to at least one of the continuous rows 46*a-n* of bristles 40 within the hair migration portion 41. As used herein, the term "substantially parallel" is intended to mean that the separation distance between the sidewall 50 and the continuous row 46*a-n* remains within 15% of the greatest separation distance along the entire longitudinal length of the hair migration portion 41. Also, as used herein, the term "immediately adjacent to" is intended to mean that no other structure feature or element having a height greater than the height of the sidewall 50 is disposed between the sidewall 50 and a closest continuous row 46*a-n* of bristles 40, and that the separation distance D between the sidewall 50 and the closest continuous row 46*a-n* of bristles 40 is less than, or equal to, 5 mm (for example, less than or equal to 3 mm, less than or equal to 2.5 mm, less than or equal to 1.5 mm, and/or any range between 1.5 mm to 3 mm).

One or more of the continuous sidewalls 50 may therefore at least partially revolve around and extend along at least a portion of the longitudinal axis/pivot axis 20 of the elongated agitator body 44 of the agitator 18 from one of a collection area 41 or an end region 48*a* of the agitator 18 and either another collection area 42 or another end region 48*b* of the elongated agitator body 44 (e.g., within the hair migration portion 41). For example, at least one of the continuous sidewalls 50 may be arranged in a generally helical, arcuate, and/or chevron configuration/pattern/shape. Optionally, one or more of the continuous sidewalls 50 (e.g., the entire row or a portion thereof) may have a constant pitch (e.g., constant helical pitch). Alternatively (or in addition), one or more of the continuous sidewalls 50 (e.g., the entire row or a portion thereof) may have a variable pitch (e.g., variable helical pitch).

According to one embodiment, one or more of the hair migration portions 41 may include a first and a second sidewall 50*a*, 50*b*. For example, a first and a second sidewall 50*a*, 50*b* may be substantially parallel to a single continuous row 46*a-n* of bristles 40 on generally opposite sides of the continuous row 46*a-n* as generally illustrated in FIG. 6. Alternatively (or in addition), a first and a second sidewall 50*a*, 50*b* may be substantially parallel to a plurality of continuous rows 46*a-n* of bristles 40 on generally opposite sides of two or more different continuous rows 46*a-n* as generally illustrated in FIG. 7. Put another way, a first and a second continuous row 46*a*, 46*n* of bristles 40 may be aligned substantially parallel to and immediately adjacent to a first and a second sidewall 50*a*, 50*b* on generally opposite sides of the first and second continuous rows 46*a*, 46*n*. One or more rows of bristles 40 (e.g., continuous row 46*b*) may be disposed between the first and second continuous rows 46*a*, 46*b*.

Figure 8:
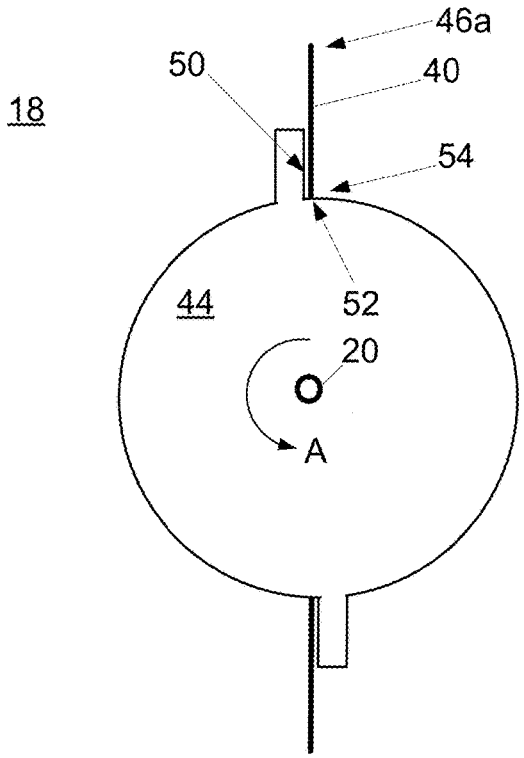
FIG. 8 is a cross-sectional view of a further embodiment of the agitator of FIG. 1 taken along lines C-C in region P.
Figure 10:
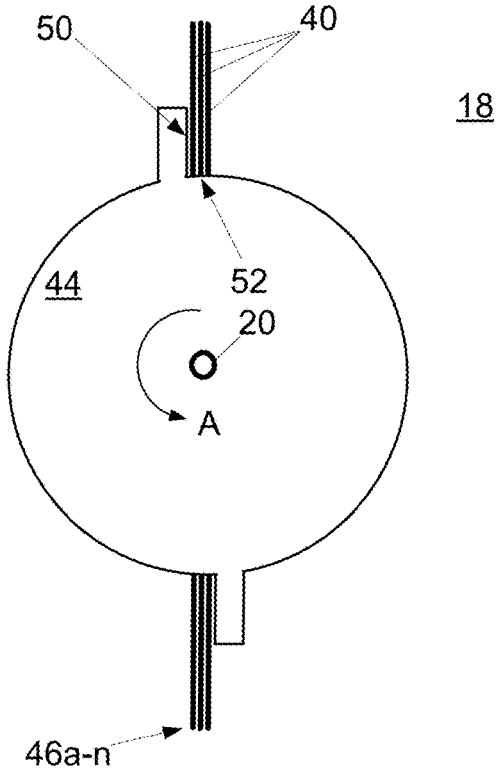
FIG. 10 is a cross-sectional view of an additional embodiment of the agitator of FIG. 1 taken along lines C-C in region P.
Figure 9:
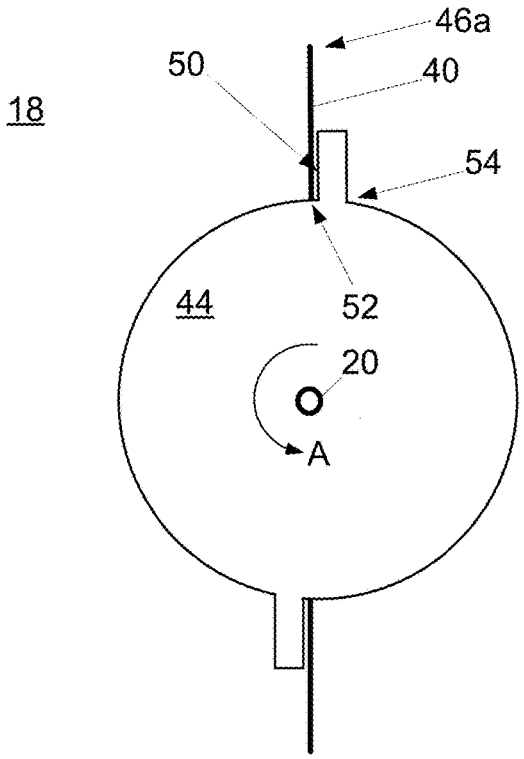
FIG. 9 is a cross-sectional view of yet embodiment of the agitator of FIG. 1 taken along lines C-C in region P.
Figure 11:
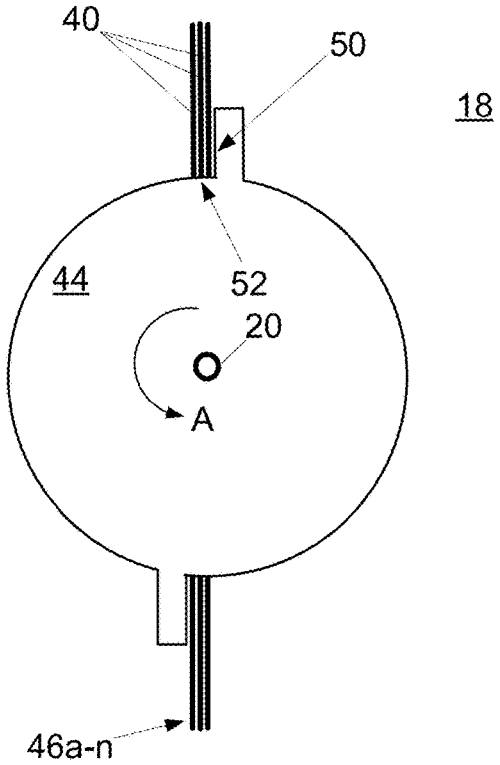
FIG. 11 is a cross-sectional view of another embodiment of the agitator of FIG. 1 taken along lines C-C in region P.

According to another embodiment, one or more of the hair migration portions 41 may include a single sidewall 50*a*, FIGS. 8-11). For example, a single sidewall 50 may be disposed immediately adjacent to a single continuous row 46*a* of bristles 40 as generally illustrated in FIGS. 8 and 9. In one embodiment, the single sidewall 50 may be disposed in front of the single continuous row 46*a* of bristles 40 as the agitator 18 rotates in the direction arrow A as generally shown in FIG. 8. Alternatively, the single sidewall 50 may be disposed behind the single continuous row 46*a* of bristles 40 as the agitator 18 rotates in the direction arrow A as generally shown in FIG. 8. Alternatively (or in addition), one or more of the hair migration portions 41 may include a single sidewall 50 disposed immediately adjacent to one of a plurality of adjacent continuous rows 46*a-n* of bristles 40 as generally illustrated in FIGS. 10 and 11. For example, the single sidewall 50 may be disposed in front of the plurality of continuous rows 46*a-n* of bristles 40 as the agitator 18 rotates in the direction arrow A as generally shown in FIG. 10. Alternatively, the single sidewall 50 may be disposed behind the plurality of continuous rows 46*a-n* of bristles 40 as the agitator 18 rotates in the direction arrow A as generally shown in FIG. 11.

Figure 12:
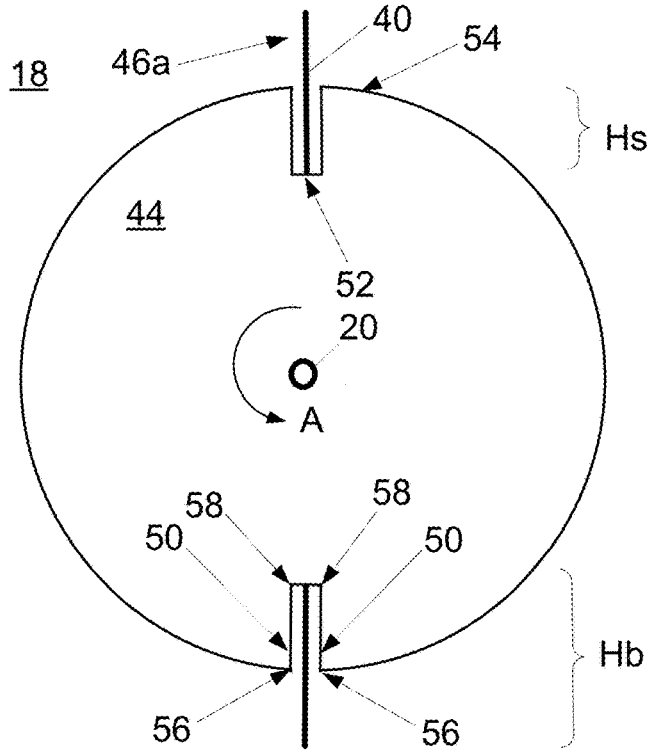
FIG. 12 is a cross-sectional view of a further embodiment of the agitator of FIG. 1 taken along lines C-C in region P.
Figure 13:
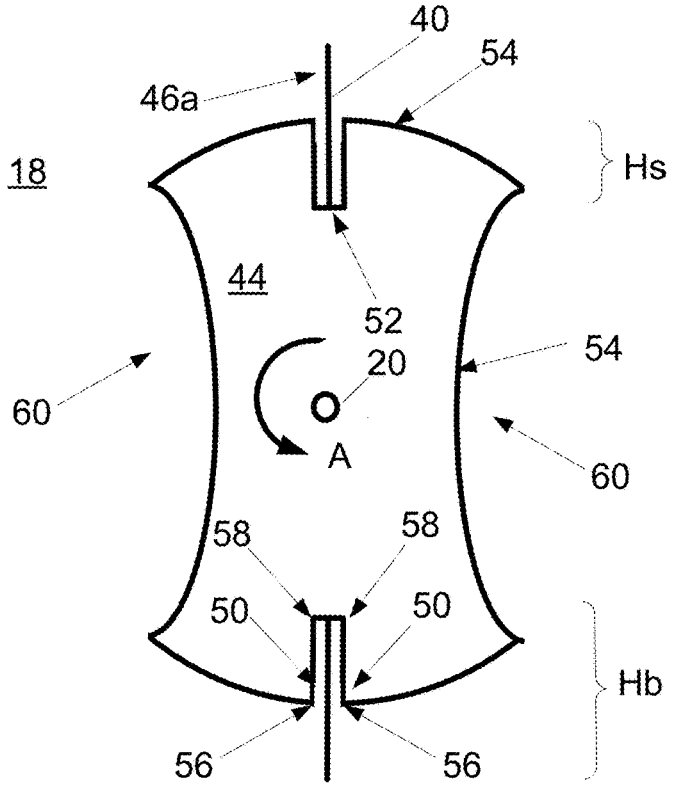
FIG. 13 is a cross-sectional view of a yet a further embodiment of the agitator of FIG. 1 taken along lines C-C in region P.

One or more of the sidewalls 50 may extend outward from a portion of the elongated agitator body 44 as generally illustrated in FIGS. 6-11. For example, one or more of the sidewalls 50 may extend outward from the base 52 of the elongated agitator body 44 from which the row 46*a-n* of bristles 40 is coupled and/or may extend outward from a portion of an outer periphery 54 of the elongated agitator body 44. Alternatively (or in addition), one or more of the sidewalls 50 may extend inward from a portion of the elongated agitator body 44 as generally illustrated in FIGS. 12-13. For example, the radially distal-most portion 56 of the sidewall 50 may be disposed at a radial distance from the pivot axis 20 of the elongated agitator body 44 that is within 20 percent of the radial distance of the adjacent, surrounding periphery 54 of the elongated agitator body 44, and the proximal-most portion 58 of the sidewall 50 (i.e., the portion of the sidewall 50 which begins to extend away from the base 52) may be disposed at a radial distance that is less than the radial distance of the adjacent, surrounding periphery 54 of the elongated agitator body 44. As used herein, the term "adjacent, surrounding periphery" is intended to refer to a portion of the periphery 54 of the elongated agitator body 44 that is within a range of 30 degrees about the pivot axis 20. While the elongated agitator body 44 in FIG. 12 is illustrated having a generally cylindrical cross-section and an outer periphery 54 that is disposed as substantially the same radial distance from the pivot axis 20, it should be appreciated that one or more portions of the elongated agitator body 44 may have a non-cylindrical cross section, e.g., and may include one or more regions 60 having either a concaved or recessed shape (as shown in FIG. 13) and/or a convex shape. As such, whereas the sidewalls 50 in FIGS. 6-11 are considered to extend outward from and beyond the adjacent, surrounding periphery 54 of the elongated body 44, the sidewalls 50 in FIGS. 12-13 are considered to extend inward from the adjacent, surrounding periphery 54 of the elongated agitator body 44 and into the elongated agitator body 44.

While the sidewalls 50 have been illustrated having a planar surface, it should be appreciated that this is not a limitation of the present disclosure unless specifically claimed as such. For example, all or a portion of one or more of the sidewalls 50 may have a nonplanar surface.

The hair migration portion 41 may therefore include at least one continuous row 46*a-n* of bristles 40 substantially parallel to at least one sidewall 50. At least a portion (e.g., all) of the bristles 40 in the at least one row 46*a-n* may have an overall height Hb (see, e.g., FIGS. 6, 12, and 13) that is in the range of 8 mm to 16 mm. The bristles 40 may have a height Hb that extends at least 2 mm. beyond the distal-most end D of the sidewall 50. The at least one sidewall 50 may have a height Hs of at least 2 mm from the base 52, and may up a height Hs that is 50% or less of the height Hb of the bristles 40. At least one sidewall 50 should be disposed close enough to the at least one row 46*a-n* of bristles 40 to increase the stiffness of the bristles 40 in at least one front-to-back direction as generally indicated by arrow F in FIG. 1 (e.g., in a plane substantially perpendicular to the pivot axis 20) compared to at least one side-to-side direction as generally indicated by arrow S in FIG. 1 (e.g., in a plane substantially parallel to the pivot axis 20). The sidewall 50 may therefore allow the bristles 40 to flex much more freely in at least one side-to-side direction compared to a front-to-back direction. For example, the bristles 40 may be 25%-40% (including all values and ranges therein) stiffer in the front-to-back direction compared to side-to-side direction.

Turning to FIGS. 1 and 3, the agitator 18 (e.g., the bristles 40) should be aligned within the agitator chamber 22 such that the bristles 40 are able to contact the surface to be cleaned. The bristles 40 should be stiff enough in at least one of the directions of arrows F to engage the surface to be cleaned (e.g., but not limited to, carpet fibers) without undesirable bending (e.g., stiff enough to agitate debris from the carpet), yet flexible enough to allow side-to-side bending in at least one direction of arrow S to allow hair 38 to migrate. Both the size (e.g., height Hs) and location of the sidewalls 50 relative to the at least one row 46*a-n* of bristles 40 may be configured to generally prevent and/or reduce hair 38 from becoming entangled around the base or bottom of the bristles 40. In addition, because the hair 38 can be prevented and/or reduced from becoming entangled about the bristles 40, the size and stiffness of the bristles 40 (in both directions F and S) as well as the size (e.g., height Hs) and location of the sidewalls 50 relative to the at least one row 46*a-n* of bristles 40 may be selected such that the bristles 40 engage hair 38 against the surface to be cleaned and bend in the direction of arrow T to generate an Archimedes screw force which urges (e.g., migrates) the hair in direction of arrow T towards a collection area 42 and/or an end region 48*a*, 48*b* of the agitator 18.

Figure 14:
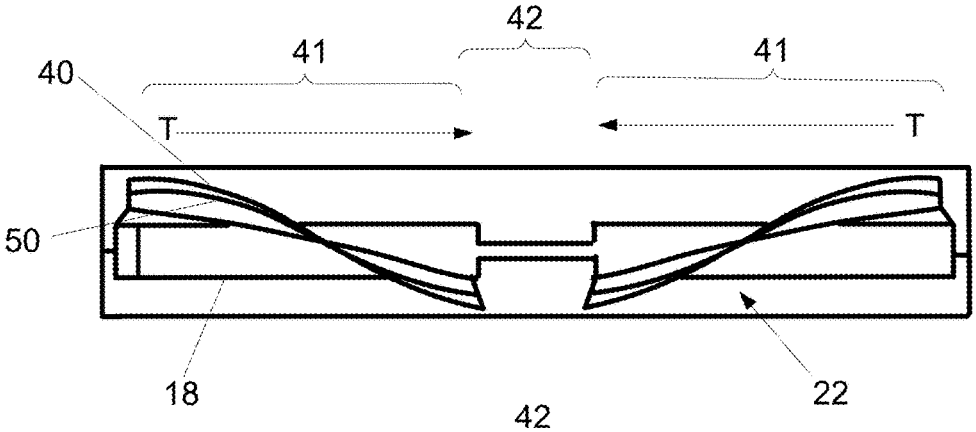
FIG. 14 is a bottom view of another embodiment of the agitator of FIG. 1.
Figure 15:
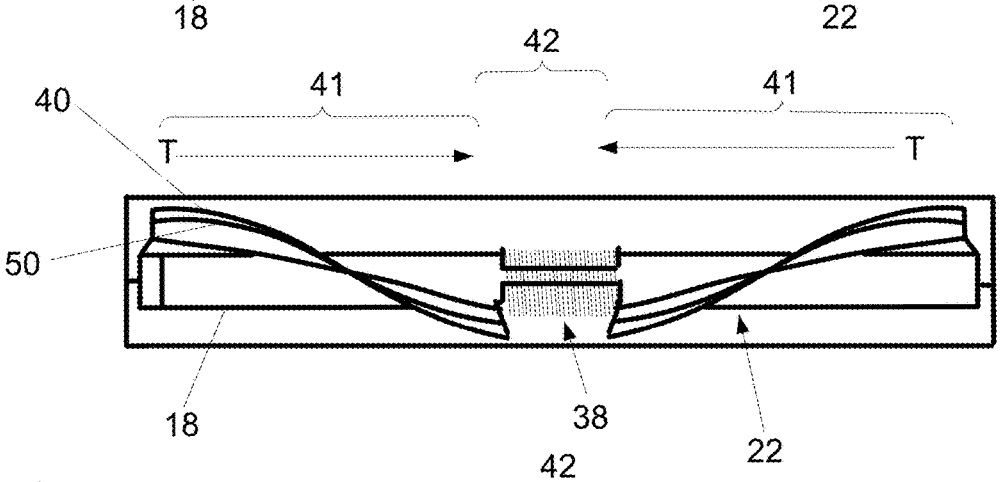
FIG. 15 is a bottom view of the agitator of FIG. 14 with hair wrapped around the collection area.

As described herein, the agitator 18 may include one or more collection areas 42. For example, a collection area 42 may include a region of the agitator 18 that is adjacent to (e.g., abutting) a hair migration region 41 and extends along the longitudinal axis 20 in the direction of hair migration travel T (e.g., FIG. 1) associated with the adjacent hair migration region 41. The collection area 42 may be configured to allow hair 38 to be collected from the hair migration region 41. For example, the collection area 42 may be configured to allow hair 38 to wrap around a region of the agitator 18 (e.g., a region of the agitator body 44). The collection area 42 may be the same as, or a separate component of, the agitator body 44. In one embodiment, one or more of the collection areas 42 may have an outer periphery (e.g., cross-section) that is the same (or substantially the same) as one or more of the portions of the agitator body 44 (e.g., the agitator body 44) adjacent to the collection area 42 as generally illustrated in FIG. 1. Alternatively (or in addition), one or more of the collection areas 42 may have an outer periphery (e.g., cross-section) that is smaller than one or more of the portions of the agitator body 44 (e.g., the agitator body 44) adjacent to the collection area 42 as generally illustrated in FIGS. 14-15.

Figure 16:
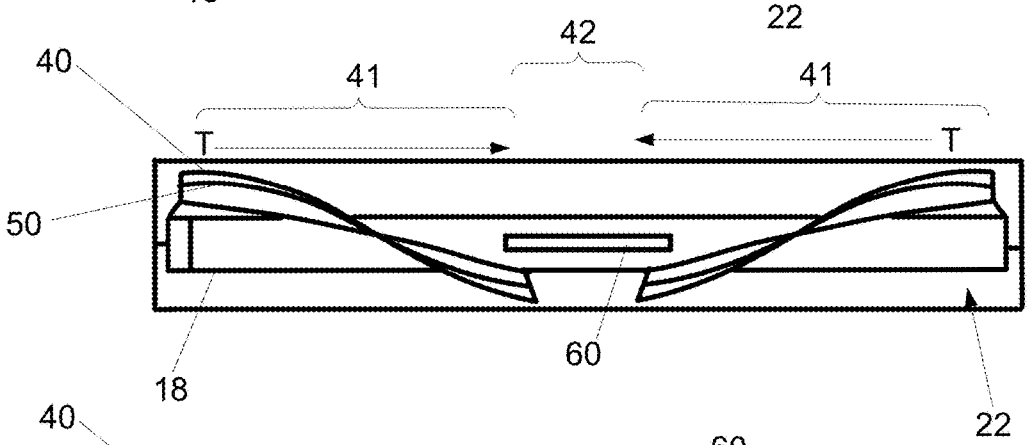
FIG. 16 is a bottom view of another embodiment of the agitator of FIG. 1.
Figure 17:
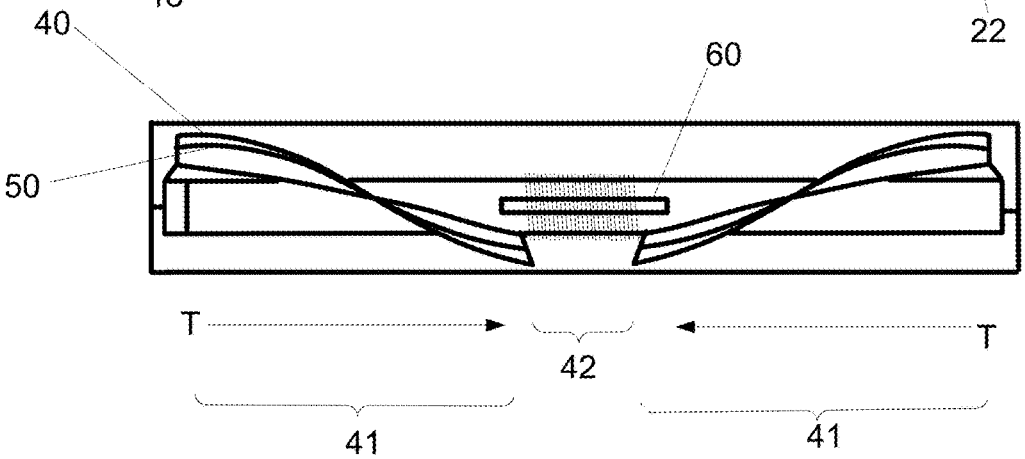
FIG. 17 is a bottom view of the agitator of FIG. 16 with hair wrapped around the collection area.

Optionally, one or more of any of the collection areas 42 consistent with the present disclosure may include a hair removal feature 61, FIG. 16. The hair removal feature 61 may include a groove, slot, opening, hole, recessed region, or the like that allows a portion of a cutting instrument (e.g., but not limited to, part of a pair of scissors or the like) to be at least partially inserted between the collected hair 38 (see, e.g., FIG. 17) and the agitator 18 (e.g., the agitator body 44). When migrated hair 38 is wrapped around the collection area 42, the hair removal feature 61 may form a generally unobstructed passage through which part of the cutting instrument (e.g., one of the blades) may be at least partially advanced (e.g., inserted) into (e.g., all the way through) to allow the user to remove (e.g., cut) the migrated hair 38. Because the migrated hair 38 within the collection area 42 is not entangled around the bristles 40, the migrated hair 38 may be easily removed from the collection area 42 once the migrated hair 38 is cut.

Figure 18:
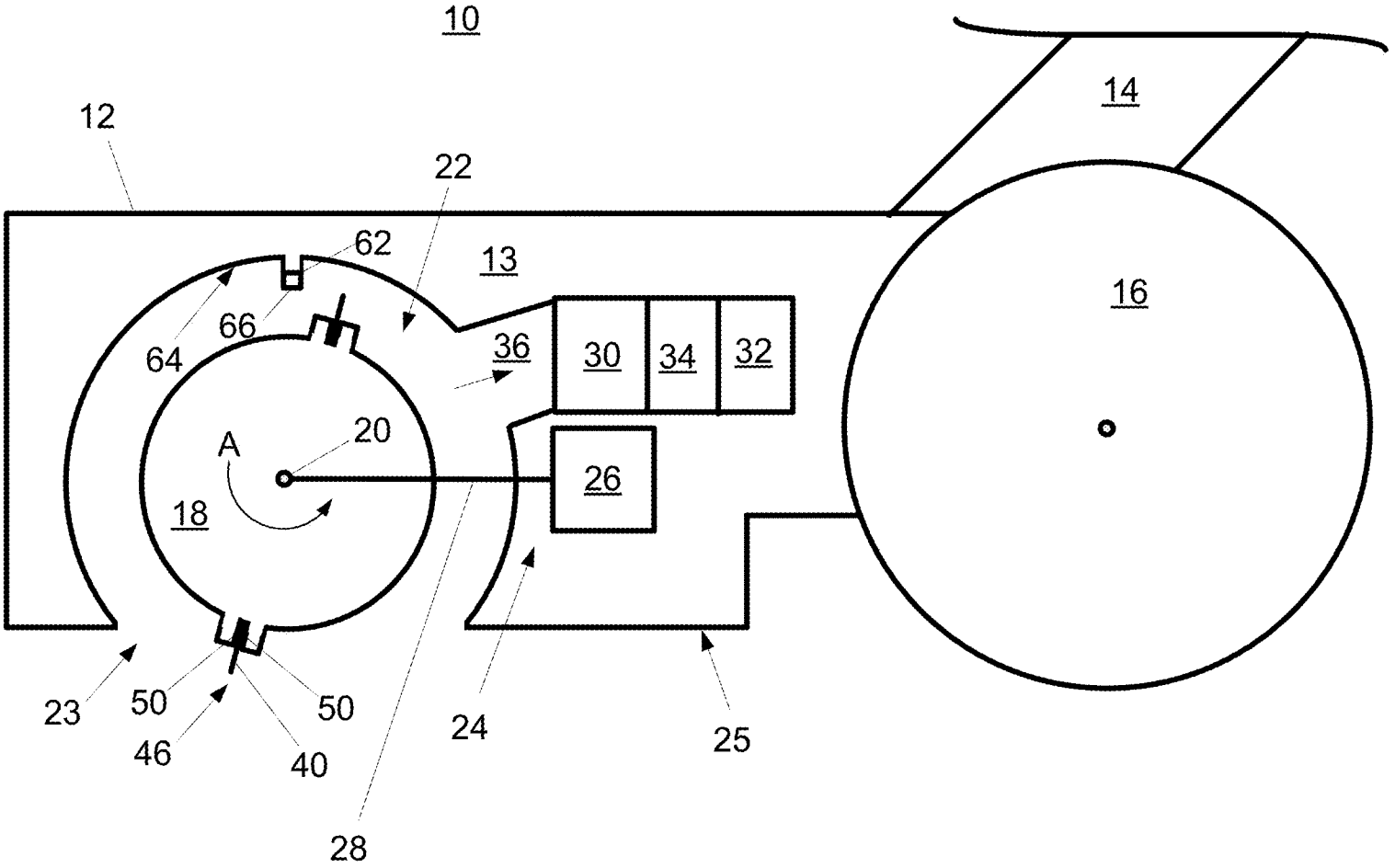
FIG. 18 is a cross-sectional view of another embodiment of a cleaning apparatus consistent with the present disclosure.

Turning now to FIG. 18, another embodiment of a surface cleaning apparatus 10 is generally illustrated. The cleaning head 12 includes one or more agitator chambers 22 including one or more agitators 18 as generally described herein. The agitator chamber 22 also includes one or more hair migration protrusions 62 that extend outward from a portion of the inner surface 64 of the agitator chamber 22 that is exposed to the agitator 18. The hair migration protrusion 62 may have a height Hp extending outward that is sufficient to engage the bristles 40 and/or sidewall 50 of the agitator 18 to generate the Archimedes screw force that urges/causes the hair 38 to migrate towards one or more collection areas 42 and/or ends 48 as described herein. One of the advantages of the surface cleaning apparatus 10 of FIG. 18 is that the height Hs, Hb of the sidewalls 50 and/or bristles 40 may be shorter compared to the embodiment of FIG. 2. As a result, the likelihood of the sidewalls 50 and/or bristles 40 damaging the surface to be cleaned (e.g., carpet fibers) may be reduced. Optionally, a contact portion 66 of one or more of the hair migration protrusions 62 (e.g., but not limited to, a distal most portion) may include a high friction surface configured to increase the friction force between the hair 38 and the hair migration protrusion 62, thereby increasing the Archimedes screw force. The contact portion 66 may include any material having a coefficient of friction greater than the coefficient of friction of the material that forms the agitator chamber 22. For example, the contact portion 66 may include any material having a coefficient of friction greater than a coefficient of friction of acrylonitrile butadiene styrene (ABS) plastic. Non-limiting examples of the contact portion 66 include a felt material, lint fabric, or the like.

One or more of hair migration protrusions 62 may extend across the entire length of the hair migration portion 41 and/or one or more of the hair migration protrusions 62 may extend across only a portion of length of the hair migration portion 41. According to one embodiment, the hair migration protrusions 62 may have a continuous distal surface which engages/contacts the hair 38 and/or may include a comb configuration in which only certain sections of the hair migration protrusions 62 engage/contact the hair 38 and adjacent sections which do not. The hair migration protrusions 62 may extend toward the agitator 18 as close as possible to the sidewall 50 as possible while still allowing the agitator 18 to rotate without damaging the bristles 40 or without excessive drag (which could damage the rotation system 24). Thus, the separation distance between the hair migration protrusions 62 and the sidewall 50 may be based on, at least in part, the thickness and flexibility of the bristles 40.

Figure 19:
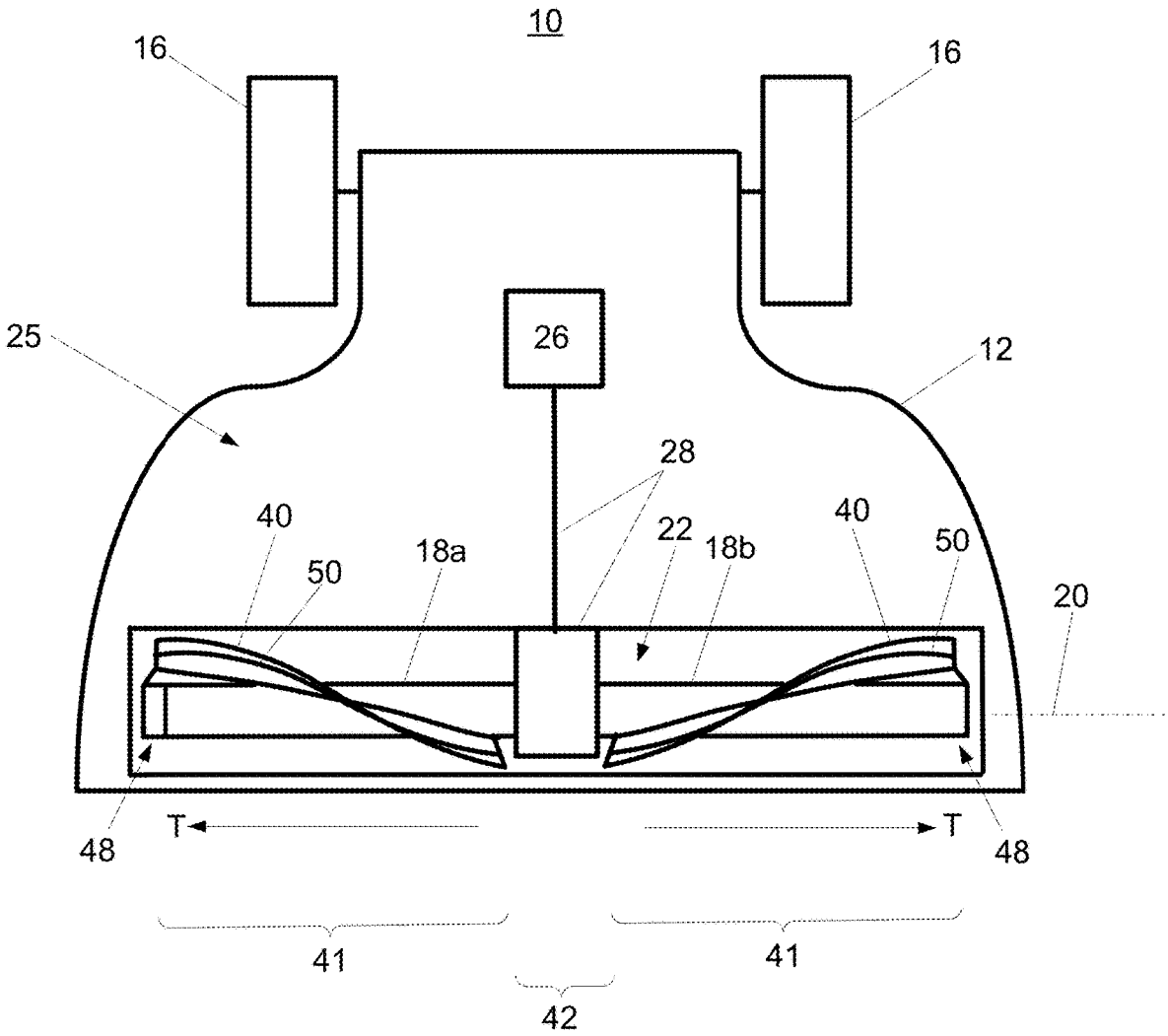
FIG. 19 is a bottom view of a further embodiment of a cleaning apparatus consistent with the present disclosure.
Figure 20:
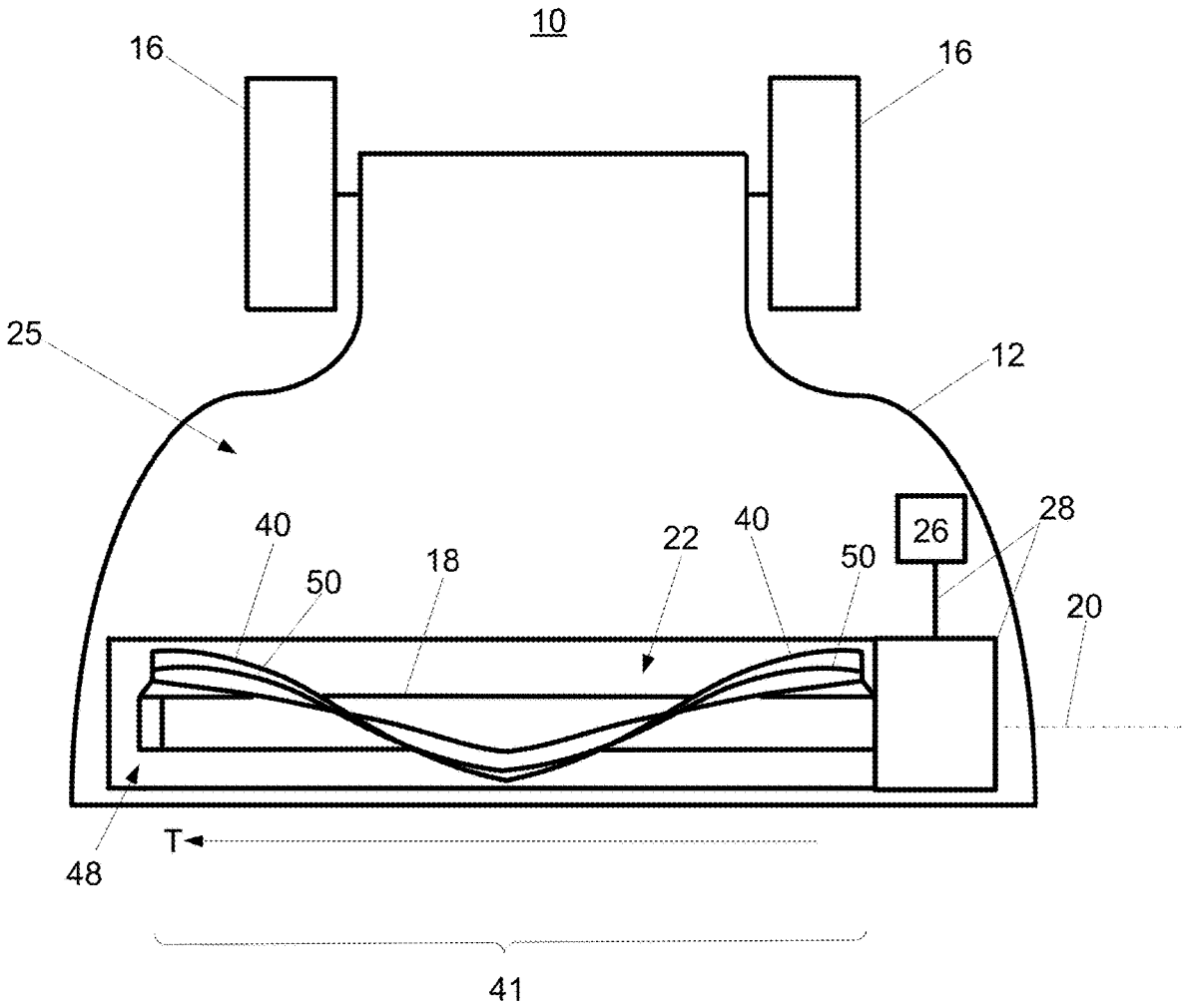
FIG. 20 is a bottom view of yet a further embodiment of a cleaning apparatus consistent with the present disclosure.

With reference now to FIG. 19, yet another embodiment of a surface cleaning apparatus 10 is generally illustrated. The cleaning head 12 includes one or more agitator chambers 22 including one or more agitators 18 as generally described herein. The cleaning head 12 may include agitator 18 may include one or more motors 26 (either AC and/or DC motors) coupled to one or more belts and/or gear trains 28 for rotating one or more agitators 18. According to one embodiment, the gear train 28 may be coupled to a first and a second agitator 18*a*, 18*b*. One or more of the first and second agitators 18*a*, 18*b* may be coupled to the gear train such that one or more of the ends 48*a*, 48*b* of the agitator 18*a*, 18*b* is free and suspended. As such, one or more hair migration portions 41 may be configured to migrate hair 38 in the direction of arrow T towards the free end 48*a*, 48*b*. The Archimedes screw force generated by the hair migration portion 41 may cause the migrated hair 38 to fall off of the free end 48*a*, 48*b* of the agitator 18. According to one embodiment, one or more agitators 18 may be coupled to and cantilevered from the gear train 28. For example, a first and a second agitator 18*a*, 18*b* may be cantilevered from the gear train 28. Alternatively (or in addition), a single agitator 18 may be coupled to the gear train 28 in a centralized region of the agitator 18, e.g., in a region disposed between the first and second ends 48*a*, 48*b* (such as, but not limited to, a middle region of the agitator 18). Additionally (or alternatively), a single agitator 18 may be coupled to and cantilevered from the gear train 28 at a single end 48*a* of the agitator 18, e.g., as generally illustrated in FIG. 20.

Figure 21:
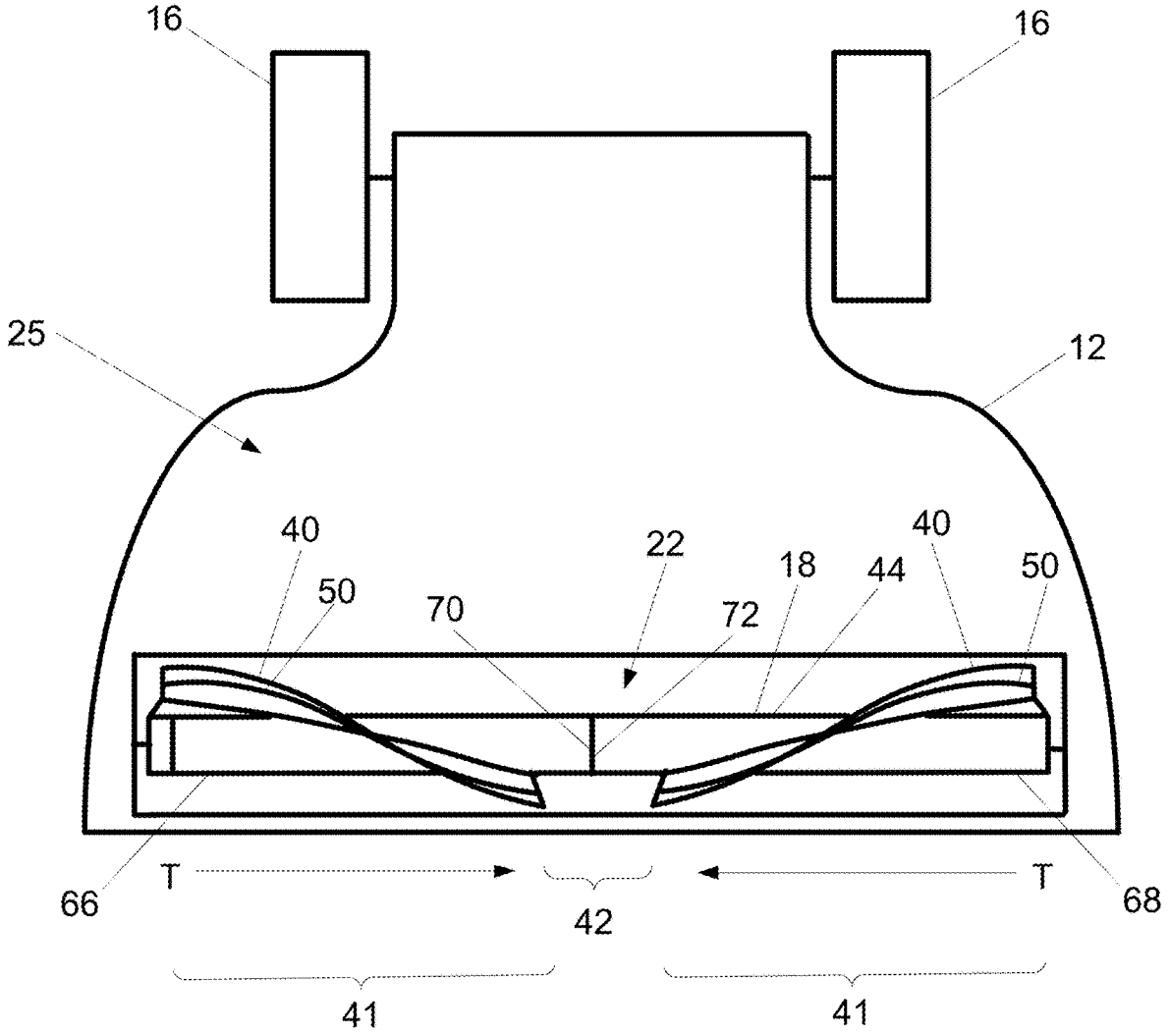
FIG. 21 is a bottom view of yet another embodiment of a cleaning apparatus including a split agitator consistent with the present disclosure.

Turning now to FIG. 21, one embodiment of a surface cleaning apparatus 10 including a multi-piece agitator 18 (e.g., split roll brush/agitator) is generally illustrated. As described herein, the agitator 18 may include one or more hair migration portions 41, an optionally one or more hair collection areas 42; however, the elongated body 44 of the agitator 18 may be formed from two or more pieces 66, 68 that are configured to be coupled together along the pivot axis 20, e.g., using two or more connections 70, 72.

Figure 22:
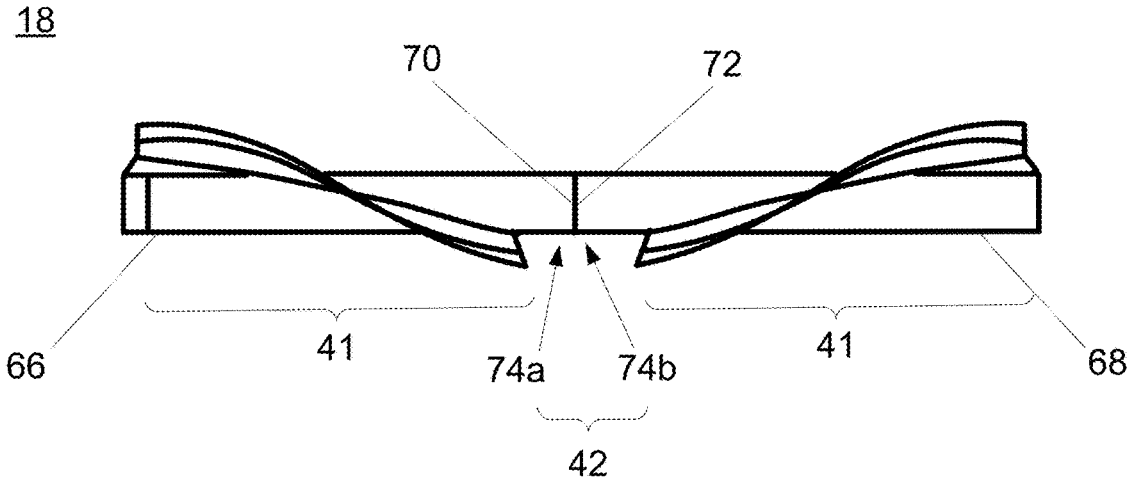
FIG. 22 is a side view of one embodiment of the split agitator of FIG. 21.

With reference to FIG. 22, the split roll agitator 18 is shown alone (i.e., without the rest of the surface cleaning apparatus 10). In the illustrated embodiment, the split roll agitator 18 includes a first and a second hair migration portion 41 that urges hair 38 to a common hair collection area 42 (see, e.g., FIG. 23), though it should be appreciated that this is just an example and that other configurations of the hair migration portions 41 and/or hair collection areas 42 described herein may be used. In the illustrated embodiment, a first and second end 74*a*, 74*b* of two adjacent pieces 66, 68 each form a portion of a hair collection area 42, though it should be appreciated that the hair collection area 42 may be formed in only one of the pieces 66, 68.

Figure 23:
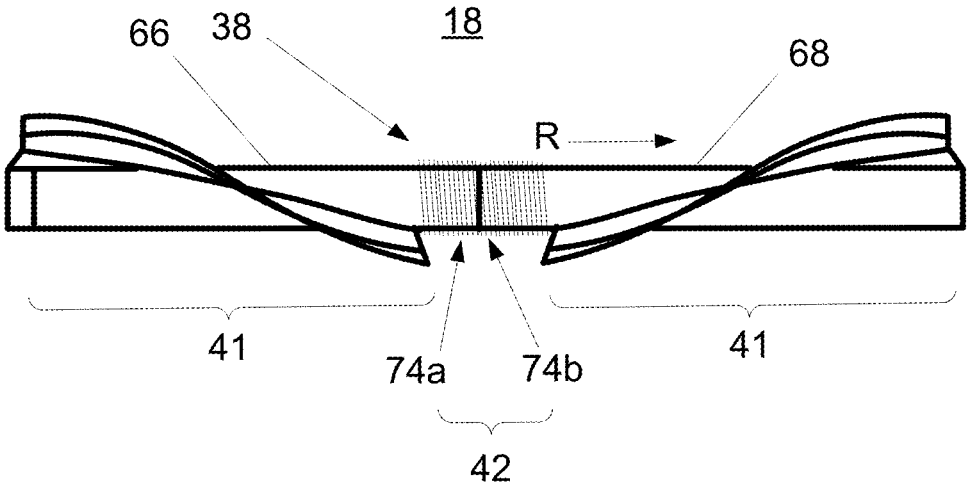
FIG. 23 is a side view of the split agitator of FIG. 22 with hair wrapped around the collection area.
Figure 24:
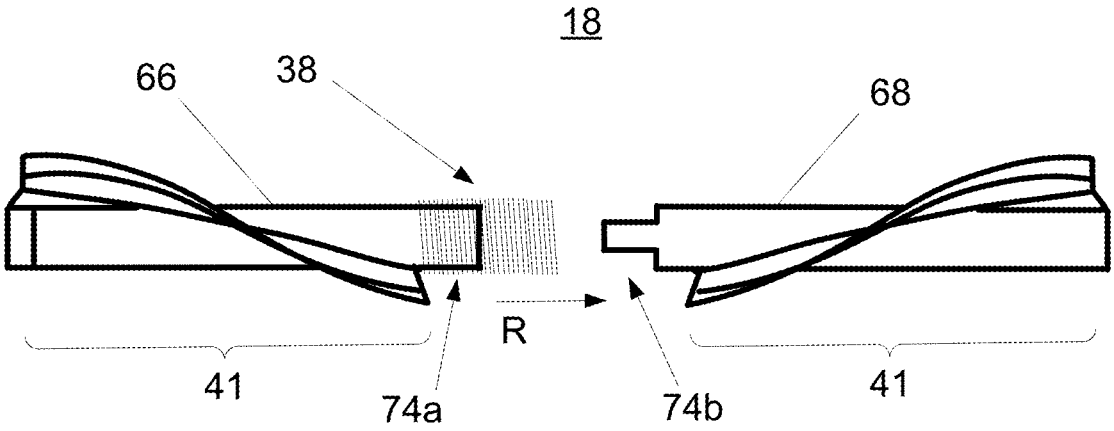
FIG. 24 is an exploded view of the split agitator of FIG. 23.

In the embodiment illustrated in FIG. 23, the user may remove the split agitator 18 from cleaning head 12 and then pull the pieces 66, 68 apart from each other (e.g., in the direction of arrow R). The collected hair 38 may then be simply removed from the ends 74*a*, 74*b* of the pieces 66, 68.

Figure 25:
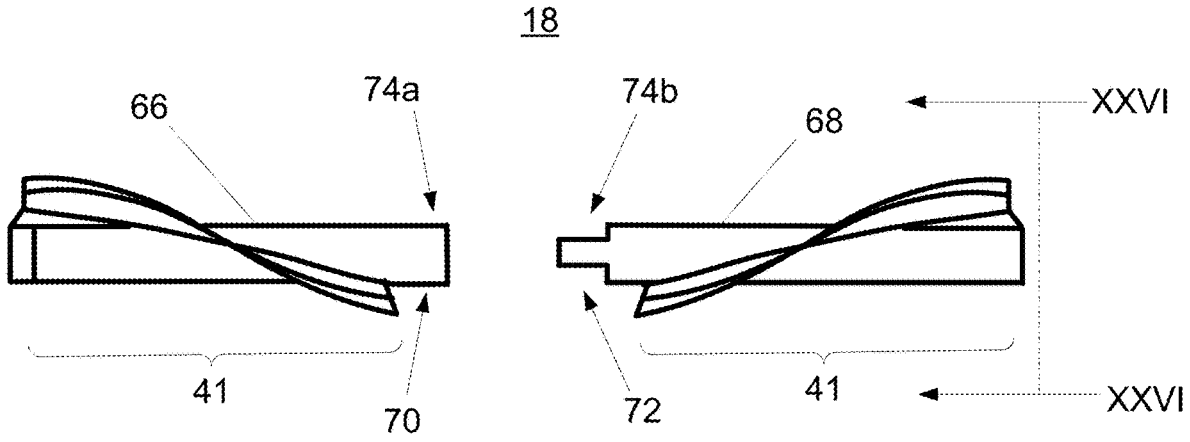
FIG. 25 is an exploded view of the split agitator of FIG. 22.
Figure 26:
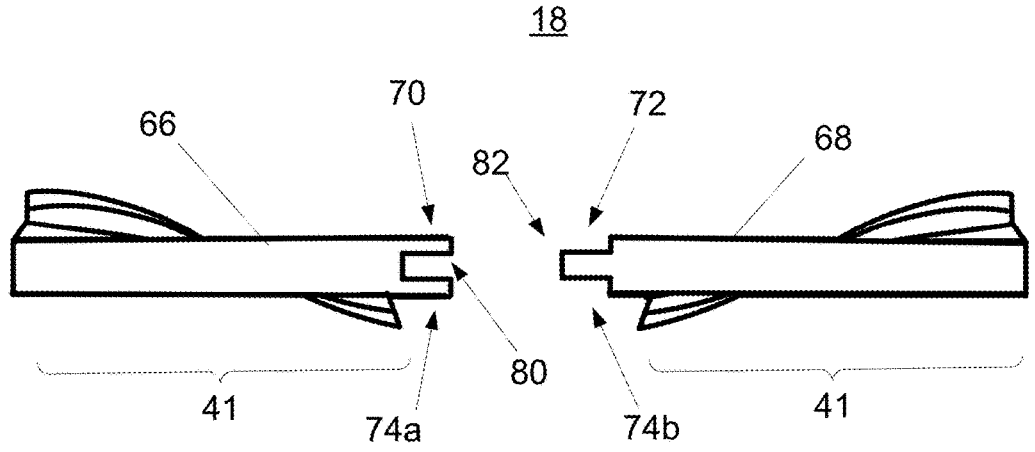
FIG. 26 is an exploded, cross-sectional view of the split agitator of FIG. 25 taken along lines XXVI-XXVI.

As noted above, the pieces 66, 68 of the split agitator 18 may each include a connection 70, 72. With reference to FIGS. 25 and 26, one embodiment of the connections 70, 72 are shown for illustrative purposes. The connections 70, 72 may include a recess 80 and a corresponding protrusion 82. The recess 80 and protrusion 82 may fit together in a lock-and-key type form (e.g., a locking connection) that allows the two pieces 66, 68 to be releasable coupled together while also generally preventing rotation of one piece 66 relative to the other piece 68 along the pivot axis 20.

To assist in removing the hair 38 from the split agitator 18, the split agitator 18 may be separable in one or more locations (e.g., connections 70, 72). The split agitator 18 may have only a single split/connection (e.g., connections 70, 72) or may have multiple splits (e.g., connections 70, 72). In one embodiment, the split agitator 18 includes a split 70, 72 at each location that there's an adjacent cross bar on the soleplate 25 to prevent against the surface cleaning apparatus 10 from sucking up the power cord. For example, the split agitator 18 may be split in two places to correspond to the two cross bars, in which case the split agitator 18 includes three separable parts.

In use, the hair 38 may be directed into one or more collection areas 42 where the agitator splits (e.g., connections 70, 72). To remove hair 38 tangled up on the split agitator 18 at the collection area 42, the split agitator 18 is first removed from the head 12 and then split into one or more parts 66, 68, thus allowing the hair 38 to drop off or be easily removed. A wiping blade may be included on the end of the bosses to aid removal of the hair such that a user will not need to touch the hair.

In any one of the embodiments described herein, one or more of the rows 46*a-n* of bristles 40 may be replaced by a continuous rubber blade and/or felt. In at least one embodiment, the rubber blade may extend along adjacent to one or more rows 46*a-n* of bristles as described herein. One or more of the rows 46*a-n* may include soft bristles 40 having diameter 0.04 mm and a length of 12 mm, and may be oriented in a at least partially revolved strip along at least a portion of the agitator 18, e.g., the hair migration portion 41.

The bristles 40 may be sized so that when used on a hard floor, it is clear of the floor in use. However, when the surface cleaning apparatus 10 is on carpet, the wheels 16 will sink in and the bristles 40 will penetrate the carpet. The length of bristles 40 may be chosen so that it is always in contact with the floor, regardless of floor surface.

To ensure optimal performance of the agitator 18, the agitator 18 may be balanced. To balance the agitator 18, the center of mass may be aligned close to the center of rotation along pivot axis 20 so that the agitator 18 does not vibrate excessively or make too much noise. To balance the agitator 18, one option is to include a component, either a core running the full width or a central section with two cores running into either side and balance the component by adding screws. Preferably, the other sections are then fitted tightly and in the same orientation every time or if possible make them thin walled so that there is very little shrinkage and they stayed very well balanced and can fit in any orientation.

According to one aspect, the present disclosure features a surface clearing apparatus includes a cleaning head and an agitator. The cleaning heat includes a cleaning head body that at least partially defines an agitator chamber. The agitator is configured to be coupled to the cleaning head at least partially within the agitator chamber and is configured to be rotated about a pivot axis extending along a longitudinal axis. The agitator includes an elongated agitator body and at least one hair migration portion. The hair migration portion comprises at least one continuous row of bristles and at least one sidewall. The at least one continuous row of bristles is at least partially revolved around and extends outward from and along at least a portion of the longitudinal axis of the elongated agitator body from one of a collection area or a first end region of the agitator and either another collection area or a second end region of the agitator. The at least one sidewall is aligned substantially parallel and immediately adjacent to the at least one continuous row of bristles within the hair migration portion. The at least one sidewall has a height Hs that is 50% or less of the height Hb of the bristles.

According to another aspect, the present disclosure features an agitator for use with a surface cleaning apparatus. The agitator is configured to be coupled to the cleaning head of the surface cleaning apparatus at least partially within an agitator chamber of the cleaning head and is configured to be rotated about a pivot axis extending along a longitudinal axis. The agitator includes an elongated agitator body and at least one hair migration portion. The hair migration portion comprises at least one continuous row of bristles and at least one sidewall. The at least one continuous row of bristles is at least partially revolved around and extends outward from and along at least a portion of the longitudinal axis of the elongated agitator body from one of a collection area or a first end region of the agitator and either another collection area or a second end region of the agitator. The at least one sidewall is aligned substantially parallel to the at least one continuous row of bristles within the hair migration portion.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus and/or agitator may embody any one or more of the features contained herein and that the features may be used in any particular combination or sub-combination. Modifications and substitutions by one of ordinary skill in the art are considered to be within the scope of the present invention, which is not to be limited except by the following claims.

What is claimed is:

1. A surface cleaning apparatus comprising:

a cleaning head including an agitator chamber;

an agitator configured to be coupled to said cleaning head at least partially within said agitator chamber and to be rotated about a pivot axis, said agitator including:

an elongated agitator body;

a first hair migration region comprising:

a first continuous row of bristles at least partially revolved around and extending outward from said elongated agitator body;

a first sidewall at least partially revolved around and extending outward from said elongated agitator body along a first side of said first continuous row of bristles; and a second sidewall at least partially revolved around and extending outward from said elongated agitator body along a second, opposite side of said first continuous row of bristles; and a plurality of protrusions in a comb configuration extending from, and being immovable relative to, the agitator chamber, the plurality of protrusions in a comb configuration configured to contact at least one of said first or said second sidewall;

wherein said first sidewall is spaced apart a first separation distance from the first continuous row of bristles;

wherein said second sidewall is spaced apart a second separation distance from the first continuous row of bristles; and wherein said first and said second sidewall each are configured to extend outward from and beyond an adjacent, surrounding periphery of said elongated body.

2. The surface cleaning apparatus of claim 1, wherein said first sidewall extends substantially parallel to said first side of said first continuous row of bristles and wherein said second sidewall extends substantially parallel to said second side of said first continuous row of bristles.

3. The surface cleaning apparatus of claim 2, wherein said first sidewall is immediately adjacent to said first side of said first continuous row of bristles and wherein said second sidewall is immediately adjacent to said second side of said first continuous row of bristles.

4. The surface cleaning apparatus of claim 1, wherein said first sidewall is immediately adjacent to said first side of said first continuous row of bristles and wherein said second sidewall is immediately adjacent to said second side of said first continuous row of bristles.

5. The surface cleaning apparatus of claim 1, wherein said first sidewall and said second sidewall extend the same distance outward from and beyond said adjacent, surrounding periphery of said elongated agitator body.

6. The surface cleaning apparatus of claim 1, wherein said first continuous row of bristles have a height that extends at least 2 mm beyond a distal-most end of the first sidewall.

7. The surface cleaning apparatus of claim 1, wherein the first sidewall has a height from a base of the elongated agitator body that is 50% or less of a height of the first continuous row of bristles.

8. The surface cleaning apparatus of claim 1, wherein at least a portion of the first continuous row of bristles has a height in the range of 8 mm to 16 mm.

9. The surface cleaning apparatus of claim 1, wherein the first sidewall has a height of at least 2 mm from the base of the elongated agitator body.

10. The surface cleaning apparatus of claim 9, wherein the height of the first sidewall is 50% or less of a height of the first continuous row of bristles.

11. The surface cleaning apparatus of claim 1, wherein said first continuous row of bristles extends outward from said elongated agitator body further than said first sidewall and said second sidewall.

12. The surface cleaning apparatus of claim 1, wherein said elongated agitator body has a substantially cylindrical cross-section.

13. The surface cleaning apparatus of claim 1, wherein said a plurality of protrusions are configured to contact said first continuous rows of bristles.

14. The surface cleaning apparatus of claim 1, wherein said plurality of protrusions extend across an entire length of the first hair migration portion.

15. The surface cleaning apparatus of claim 1, wherein the first separation distance is between 1.5 mm and 3 mm, and wherein said second separation distance is between 1.5 mm and 3 mm.

16. A surface cleaning apparatus comprising:

a cleaning head including an agitator chamber;

an agitator configured to be rotate about a pivot axis, wherein said agitator includes a first and a second end and said agitator is coupled and cantilevered to said cleaning head such that said second end of said agitator is a free end, said agitator further including:

an elongated agitator body;

a first hair migration region comprising:

a first continuous row of bristles at least partially revolved around and extending outward from said elongated agitator body;

a first sidewall at least partially revolved around and extending outward from said elongated agitator body along a first side of said first continuous row of bristles; and a second sidewall at least partially revolved around and extending outward from said elongated agitator body along a second, opposite side of said first continuous row of bristles;

wherein said first sidewall is spaced apart a first separation distance from the first continuous row of bristles;

wherein said second sidewall is spaced apart a second separation distance from the first continuous row of bristles; and wherein said first and said second sidewall each are configured to extend outward from and beyond an adjacent, surrounding periphery of said elongated body.

17. The surface cleaning apparatus of claim 16, wherein said first continuous row of bristles, said first sidewall, and said second sidewall extend substantially continuously from said first end of said agitator to said second end of said agitator.

18. The surface cleaning apparatus of claim 17, wherein agitator is configured to migrate hair from said first end of said agitator towards said second end of said agitator.

19. The surface cleaning apparatus of claim 17, wherein said first continuous row of bristles, said first sidewall, and said second sidewall extend in a generally helical pattern from said first end of said agitator to said second end of said agitator.

20. A surface cleaning apparatus comprising:

a cleaning head including an agitator chamber;

an agitator configured to be coupled to said cleaning head at least partially within said agitator chamber and to be rotated about a pivot axis, said agitator including:

an elongated agitator body;

a first hair migration region comprising:

a first continuous row of bristles at least partially revolved around and extending outward from said elongated agitator body;

a first sidewall at least partially revolved around and extending outward from said elongated agitator body substantially parallel and immediately adjacent to a first side of said first continuous row of bristles; and a second sidewall at least partially revolved around and extending outward from said elongated agitator body substantially parallel and immediately adjacent to a second, opposite side of said first continuous row of bristles;

a plurality of protrusions in a comb configuration extending from, and being immovable relative to, said agitator chamber and configured to extend across an entire length of the first hair migration portion, to contact said first continuous rows of bristles and contact said first and said second sidewall;

wherein said first sidewall is spaced apart a first separation distance from the first continuous row of bristles;

wherein said first and said second sidewall each are configured to extend the same distance outward from and beyond an adjacent, surrounding periphery of said elongated body; and wherein said first continuous row of bristles extends outward from said elongated agitator body further than said first sidewall and said second sidewall.

21. The surface cleaning apparatus of claim 20, wherein said agitator includes a first and a second end and said agitator is coupled and cantilevered to said cleaning head such that said second end of said agitator is a free end.

22. The surface cleaning apparatus of claim 21, wherein said first continuous row of bristles, said first sidewall, and said second sidewall extend substantially continuously from said first end of said agitator to said second end of said agitator.

23. The surface cleaning apparatus of claim 22, wherein agitator is configured to migrate hair from said first end of said agitator towards said second end of said agitator.

24. The surface cleaning apparatus of claim 20, wherein the first separation distance is between 1.5 mm and 3 mm.

* * * * *